US008449051B2

(12) United States Patent
Lam et al.

(10) Patent No.: US 8,449,051 B2
(45) Date of Patent: May 28, 2013

(54) DRAWER ASSEMBLY

(75) Inventors: Harn Lian Lam, Ipoh (MY); Harn Yan Lam, Ipoh (MY)

(73) Assignee: Harn Marketing Sdn. Bhd., Perak (MY)

( * ) Notice: Subject to any disclaimer, the term of this patent is extended or adjusted under 35 U.S.C. 154(b) by 135 days.

(21) Appl. No.: 12/844,567

(22) Filed: Jul. 27, 2010

(65) Prior Publication Data

US 2011/0037366 A1 Feb. 17, 2011

(30) Foreign Application Priority Data

Aug. 12, 2009 (MY) ..... PI 20093361

(51) Int. Cl.
*A47B 88/04* (2006.01)

(52) U.S. Cl.
USPC ..... 312/333; 312/334.6; 312/334.1

(58) Field of Classification Search
USPC ..... 312/333, 319.1, 334.6, 334.7, 334.1, 312/334.8, 334.14; 384/20, 21
See application file for complete search history.

(56) References Cited

U.S. PATENT DOCUMENTS

| | | | | |
|---|---|---|---|---|
| 1,902,795 | A * | 3/1933 | Wolters | 312/331 |
| 5,207,781 | A * | 5/1993 | Rock | 312/319.1 |
| 5,364,179 | A * | 11/1994 | Brustle et al. | 312/333 |
| 5,564,807 | A * | 10/1996 | Rock et al. | 312/331 |
| 6,736,471 | B2 | 5/2004 | Lin | |
| 6,752,478 | B1 | 6/2004 | Francz | |
| 6,846,053 | B2 | 1/2005 | Salice | |
| 6,945,617 | B2 * | 9/2005 | Wong | 312/334.1 |
| 6,945,620 | B2 * | 9/2005 | Lam et al. | 312/334.6 |
| 6,953,233 | B2 * | 10/2005 | Lam et al. | 312/333 |
| 6,979,065 | B2 * | 12/2005 | Egger | 312/333 |
| 7,108,339 | B2 * | 9/2006 | Berger | 312/333 |
| 7,156,478 | B2 * | 1/2007 | Harn et al. | 312/334.6 |
| 7,249,813 | B2 * | 7/2007 | Gasser | 312/333 |
| 7,296,863 | B2 * | 11/2007 | Lam et al. | 312/334.6 |
| 7,374,260 | B2 * | 5/2008 | Lu | 312/333 |
| 7,384,108 | B2 | 6/2008 | Lam et al. | |
| 7,399,041 | B2 | 7/2008 | Prentner et al. | |
| 7,410,154 | B2 * | 8/2008 | Lam et al. | 267/226 |
| 7,472,973 | B2 * | 1/2009 | Huang | 312/333 |
| 7,549,712 | B2 * | 6/2009 | Booker et al. | 312/334.6 |
| 7,731,311 | B2 * | 6/2010 | Lam et al. | 312/333 |

(Continued)

FOREIGN PATENT DOCUMENTS

| | | |
|---|---|---|
| CN | 1619181 | 5/2005 |
| DE | 24 21 657 | 11/1975 |

(Continued)

*Primary Examiner* — James O Hansen
*Assistant Examiner* — Kimberley S Wright
(74) *Attorney, Agent, or Firm* — Volpe and Koenig, P.C.

(57) ABSTRACT

A drawer assembly having a drawer and a sliding guide rail system for slidably opening and closing the drawer within an article of furniture is disclosed. A contact piece is provided on a drawer element. A damping device and a channel guide are provided within the guide rail system. The channel guide has a sliding member that includes an inner portion and an outer portion that extends from the guide so as to be contactable by the contact piece. The sliding member inner portion locates an end of the damping device. During a closing action, the drawer is caused to slide in a closing direction. When the contact piece reaches and contacts the sliding member outer portion, the sliding member travels within the channel guide against the resilience of the damping device and causes deceleration of the closing motion.

14 Claims, 19 Drawing Sheets

U.S. PATENT DOCUMENTS

| | | | | |
|---|---|---|---|---|
| 7,758,135 | B2 * | 7/2010 | Lam et al. | 312/334.6 |
| 7,762,637 | B2 * | 7/2010 | Lam et al. | 312/334.6 |
| 7,845,744 | B2 * | 12/2010 | Chen et al. | 312/334.6 |
| 7,914,093 | B2 * | 3/2011 | Huang | 312/333 |
| 7,926,630 | B2 * | 4/2011 | Baldreich | 188/205 R |
| 8,083,304 | B2 * | 12/2011 | Hu | 312/333 |
| 8,109,582 | B2 * | 2/2012 | Dubach | 312/319.1 |
| 8,136,898 | B2 * | 3/2012 | Ruter | 312/333 |
| 2001/0008358 | A1 | 7/2001 | Brustle | |
| 2002/0096405 | A1 | 7/2002 | Gasser | |
| 2003/0067257 | A1 | 4/2003 | Gasser | |
| 2004/0000850 | A1 * | 1/2004 | Lam Harn et al. | 312/333 |
| 2004/0000851 | A1 | 1/2004 | Lam Harn et al. | |
| 2004/0104650 | A1 | 6/2004 | Egger | |
| 2005/0098394 | A1 | 5/2005 | Baldreich | |
| 2005/0116593 | A1 | 6/2005 | Berger | |
| 2005/0231083 | A1 * | 10/2005 | Garcie | 312/333 |
| 2005/0276526 | A1 * | 12/2005 | Harn et al. | 384/18 |
| 2006/0186772 | A1 * | 8/2006 | Lam et al. | 312/333 |
| 2006/0279186 | A1 * | 12/2006 | Lam et al. | 312/319.1 |
| 2007/0046159 | A1 | 3/2007 | Hoffman | |
| 2007/0057609 | A1 * | 3/2007 | Lam et al. | 312/334.31 |
| 2007/0080616 | A1 * | 4/2007 | Lam et al. | 312/334.6 |
| 2007/0126324 | A1 * | 6/2007 | Lee | 312/402 |
| 2007/0278917 | A1 * | 12/2007 | Yang | 312/330.1 |
| 2008/0157643 | A1 * | 7/2008 | Chen | 312/334.6 |
| 2009/0021129 | A1 * | 1/2009 | Hu et al. | 312/333 |
| 2009/0278432 | A1 * | 11/2009 | Lam et al. | 312/334.44 |
| 2010/0123378 | A1 * | 5/2010 | Chen et al. | 312/333 |
| 2010/0293746 | A1 * | 11/2010 | Johansson et al. | 16/85 |
| 2011/0037362 | A1 * | 2/2011 | Park et al. | 312/319.1 |
| 2011/0095670 | A1 * | 4/2011 | Cho et al. | 312/405.1 |
| 2011/0115353 | A1 * | 5/2011 | Domenig et al. | 312/333 |
| 2012/0049713 | A1 * | 3/2012 | Tingle et al. | 312/334.33 |

FOREIGN PATENT DOCUMENTS

| | | | |
|---|---|---|---|
| DE | 202 17 975 | U1 | 1/2003 |
| DE | 202 18 067 | U1 | 1/2003 |
| DE | 20 2004 019 738 | U1 | 3/2005 |
| DE | 203 18 929 | U1 | 4/2005 |
| DE | 203 19 598 | U1 | 5/2005 |
| EP | 1 106 768 | A2 | 6/2001 |
| EP | 1 188 397 | A1 | 3/2002 |
| EP | 1 336 357 | | 8/2003 |
| EP | 1 336 357 | A | 8/2003 |
| EP | 1336357 | A1 | 8/2003 |
| EP | 1 479 317 | A | 11/2004 |
| EP | 1692969 | A1 | 8/2006 |
| WO | 01/50917 | A1 | 7/2001 |
| WO | 2004/045339 | A | 6/2004 |
| WO | 2005/011438 | A1 | 2/2005 |
| WO | 2005/044046 | A1 | 5/2005 |
| WO | WO 2010011822 | A1 * | 1/2010 |

* cited by examiner

DRAWER ASSEMBLY

This invention relates to a drawer assembly.

More particularly, this invention relates to a drawer assembly having a sliding guide rail system for slidably opening or closing a drawer within an article of furniture.

DESCRIPTION OF THE PRIOR ART

Drawer guide rails are components in common every day use, such as for drawers in desks or cabinets, and for industrial use such as pull out storage shelves at a warehouse, cash registers at a supermarket, automated teller machines at banking kiosks, electronic equipment at telephone switching stations and so on.

Guide rail systems are provided for drawers to be either partially or fully opened or closed and typically consist of a bracket for fixing the system to the article of furniture, a fixed rail mounted on the bracket, a pull-out rail attached to the side of the drawer, and preferably an intermediate rail in between the fixed and pull-out rails. The intermediate rail is slidable over the fixed rail and the pull-out rail is slidable over the intermediate rail normally due to slidable roller housings disposed within the fixed and pull-out rails. Each of the fixed, intermediate and pull-out rails is also normally disposed with pairs of limit stoppers. The distance traveled by the slidable roller housings between each pair of limit stoppers on each rail element typically defines the travel distance of each rail.

When a drawer having this typical guide rail system is pushed in or closed with excessive force, loud noise would inevitably be produced as a result of contact and movement between the rail elements as well as sliding housings. Also and more importantly, excessive force results in accelerated and uncontrolled closing motion of this typical guide rail assembly which would damage the rail elements of the assembly and the article of furniture.

Hence, a guide rail assembly that allows for controlled decelerated closing motion of a drawer was developed and disclosed in Malaysian patent application no. PI 20055626.

In this prior rail assembly, a mounting bracket, a fixed rail, an intermediate rail and an outer pull out rail is provided. As per the typical guide rail system explained above, roller housings are provided so as to enable the intermediate rail and outer pull out rail to be slidable. A fluid damper and a channel guide having a sliding member are disposed end-to-end along the mounting bracket adjacent its fixed rail. A protrusion is provided on the bottom surface of the outer pull-out rail. The sliding member comprises an inner portion that travels within the channel guide and an outer portion that extends from the guide so as to be contactable by the pull out rail protrusion. In different variations of this prior assembly, a distal end of the fluid damper rod is located either within the sliding member inner portion or outer portion. During a drawer closing motion, the outer pull out rail is caused to slide in a drawer-closing direction and when the protrusion reaches and contacts the sliding member outer portion, the sliding member is urged to travel within the channel guide against the resilience of the fluid damper, hence, causing deceleration of the drawer-closing motion.

As is the problem with most sliding guide rail systems, there is significant space constraint for elements within the rail system, since the system as a whole needs to be of minimal width and height so as to fit either within a double-walled drawer side or underneath a drawer bottom, without decreased performance or functionality. Hence, the element (outer pull out rail protrusion) provided to operatively interact with the fluid damper-channel guide configuration for deceleration of the drawer closing motion in this prior assembly is of a small size so as to fit towards a front longitudinal end of the pull out rail, without affecting the function of the pull out rail as part of the sliding guide rail system.

In this prior assembly, the outer pull out rail protrusion is provided in two variations, either as a small rectangular block or a C-shaped bracket. The front longitudinal end of both variations of the pull out rail protrusion has a small sidewardly protruding surface contactable with the sliding member outer portion for initiating deceleration of the drawer closing motion. In other words, deceleration of the drawer closing motion in this prior assembly is dependent on a small force-absorbing surface i.e. the pull out rail protrusion protruding contact surface.

In use, it has been observed that this prior system is ineffective in decelerating drawer closing motion when it is used with a large and/or heavily loaded drawer, especially when excessive force is used in pushing in the drawer.

In addition to noise and damage to the drawer and article of furniture, this also results in damage to the rail elements of the system in the long run and necessitates replacement of some of the elements or the guide rail system as a whole.

This invention thus aims to alleviate some or all of the problems of the prior art.

SUMMARY OF THE INVENTION

In one aspect of the invention, a drawer assembly comprising a drawer and a sliding guide rail system for slidably opening and closing the drawer within an article of furniture is provided. The drawer includes a drawer side member. The sliding guide rail system includes a mounting bracket for fixing the drawer to the article of furniture, the mounting bracket having a fixed rail for receiving an intermediate rail, an intermediate rail capable of sliding back and forth relative to the fixed rail, and an outer pull out rail operatively attached to the drawer and being capable of sliding back and forth on the intermediate rail relative to the intermediate rail and the fixed rail. A contact piece is provided on the drawer side member. A damping device and a channel guide is disposed along the mounting bracket adjacent the fixed rail. The damping device is resiliently compressible in a lengthwise direction and the channel guide has a sliding member. The sliding member includes an inner portion that travels within the guide and an outer portion that extends from the guide so as to be contactable by the drawer side contact piece. The inner portion locates an end of the damping device that can be pushed inwardly to provide damping. During a closing action of the assembly, both the drawer and the outer pull out rail is caused to slide in a drawer-closing direction. When the drawer side contact piece reaches and engages the sliding member outer portion, the sliding member travels within the channel guide against the resilience of the damping device and causes deceleration of the drawer-closing motion.

In an embodiment, the drawer side member may comprise a cover piece and a support bracket, the cover piece fitting over the support bracket.

The drawer side contact piece may be removably affixed to the bottom of the drawer side support bracket so as to be engageable with the sliding member outer portion. The drawer side contact piece may comprise an attachment part and a contact part, the attachment part for removably attaching the contact piece to the support bracket and the contact part for engagement with the sliding member outer portion. The contact part may further comprise a substantially T-shaped abutment face engageable with the sliding member outer portion.

In a further embodiment, the damping device may comprise a cylinder body and a rod that is pushable into the cylinder body when the device is compressed; the distal end of the rod located in the sliding member inner portion.

According to an embodiment, the damping device may be a fluid damper.

According to another embodiment, the channel guide may be a U-shaped channel having an open side and open longitudinal ends such that the sliding member outer portion extends outwardly through the open side of the channel guide and the sliding member inner portion receives an end of the damping device through an open longitudinal end.

According to a further embodiment, the sliding member inner portion may further comprise an aperture for receiving an end of the damping device.

According to yet another embodiment, the fixed rail may further comprise a stopper tab located at a position on the fixed rail upper surface such that the stopper tab is forward relative to the rear travel limit position of the sliding member within the channel guide. The stopper tab may be an L-shaped tab. The outer pull out rail may further comprise a stopper piece engageable with the fixed rail stopper tab.

In accordance with another aspect of the invention, a drawer assembly comprising a drawer and a sliding guide rail system for slidably opening and closing the drawer within an article of furniture is provided. The drawer includes a drawer bottom panel. The sliding guide rail system includes a mounting bracket for fixing the guide rail system to the article of furniture, the mounting bracket having a fixed rail for receiving an intermediate rail, an intermediate rail capable of sliding back and forth relative to the fixed rail, an outer pull out rail operatively attached to the drawer and being capable of sliding back and forth on the intermediate rail relative to the intermediate rail and the fixed rail. A contact piece is provided on the drawer bottom panel. A damping device and a channel guide are disposed along the mounting bracket adjacent its fixed rail, the damping device being resiliently compressible in a lengthwise direction and the channel guide having a sliding member. The sliding member includes an inner portion that travels along the guide and an outer portion that extends from the guide so as to be contactable by the drawer bottom contact piece. The inner portion locates an end of the damping device that can be pushed inwardly to provide damping. During a closing action of the assembly, both the drawer and the outer pull out rail are caused to slide in a drawer-closing direction. When the drawer bottom contact piece reaches and contacts the sliding member outer portion, the sliding member travels within the channel guide against the resilience of the damping device and causes deceleration of the drawer-closing motion.

In an embodiment of this aspect, the drawer bottom contact piece is removably affixed to the bottom of the drawer bottom panel, at its front corner, so as to be engageable with the sliding member outer portion. The drawer bottom contact piece may comprise an attachment part and a contact part, the attachment part for removably attaching the contact piece to the drawer bottom panel and the contact part for engagement with the sliding member outer portion. The contact part may further comprise a rearwardly projecting arm having an abutment face on its terminal end that is engageable with the sliding member outer portion. The drawer bottom contact piece may comprise an engagement means for releasably engaging the drawer to the sliding guide rail system.

In another embodiment of this aspect, the damping device may comprise a cylinder body and a rod that is pushable into the cylinder body when the device is compressed, the distal end of the rod being located in the sliding member inner portion.

In a further embodiment of this aspect, the damping device may be a fluid damper.

According to an embodiment of this aspect, the channel guide may comprise a C-shaped housing. The channel guide may further comprise a slot disposed along its length such that the sliding member outer portion extends sidewardly through the slot.

According to another embodiment of this aspect, the sliding member inner portion may further comprise an aperture for receiving the end of the damping device.

According to a further embodiment of this aspect, the mounting bracket may further comprise a stopper tab disposed adjacent the channel guide such that the stopper tab is forward relative to the rear travel limit position of the sliding member within the channel guide. The outer pull out rail may further comprise a stopper contact piece engageable with the mounting bracket stopper tab.

According to yet another embodiment of this aspect, the intermediate rail may comprise a C-shaped guide that is slidable along the mounting bracket fixed rail and a channel piece disposed on top of the C-shaped guide, whereby the outer pull out rail is slidable along the channel piece of the intermediate rail.

In an embodiment of both aspects of the invention, the outer pull out rail stopper contact piece may be disposed toward a front end of the pull out rail. Also, the outer pull out rail stopper contact piece may be removable from the pull out rail.

According to another embodiment of both aspects of the invention, the fixed rail and outer pull out rail each may further comprise a slidable housing having a plurality of rollers that enables the intermediate rail to be slidable on the fixed rail and the outer pull out rail to be in turn slidable on the intermediate rail.

The objective of the drawer assembly of this invention is to provide a substantially quiet, controlled and decelerated drawer-closing motion with an assembly of a sufficiently robust design to withstand excessive drawer-closing force without the need for frequent replacements of drawer or guide rail elements.

The design of the drawer assembly of this invention advantageously allows for the contact piece, pivotal in initiating deceleration of the drawer closing motion, to be provided on a drawer element, either a drawer side member or a drawer bottom panel. This would result in significantly improved efficiency in deceleration of the drawer closing motion as well as decrease likelihood of damage to the elements of the guide rail system.

BRIEF DESCRIPTION OF THE DRAWINGS

The invention is illustrated, although not limited, by the following description of embodiments made with reference to the accompanying drawings in which.

DETAILED DESCRIPTION OF THE EMBODIMENTS

Figure 1:
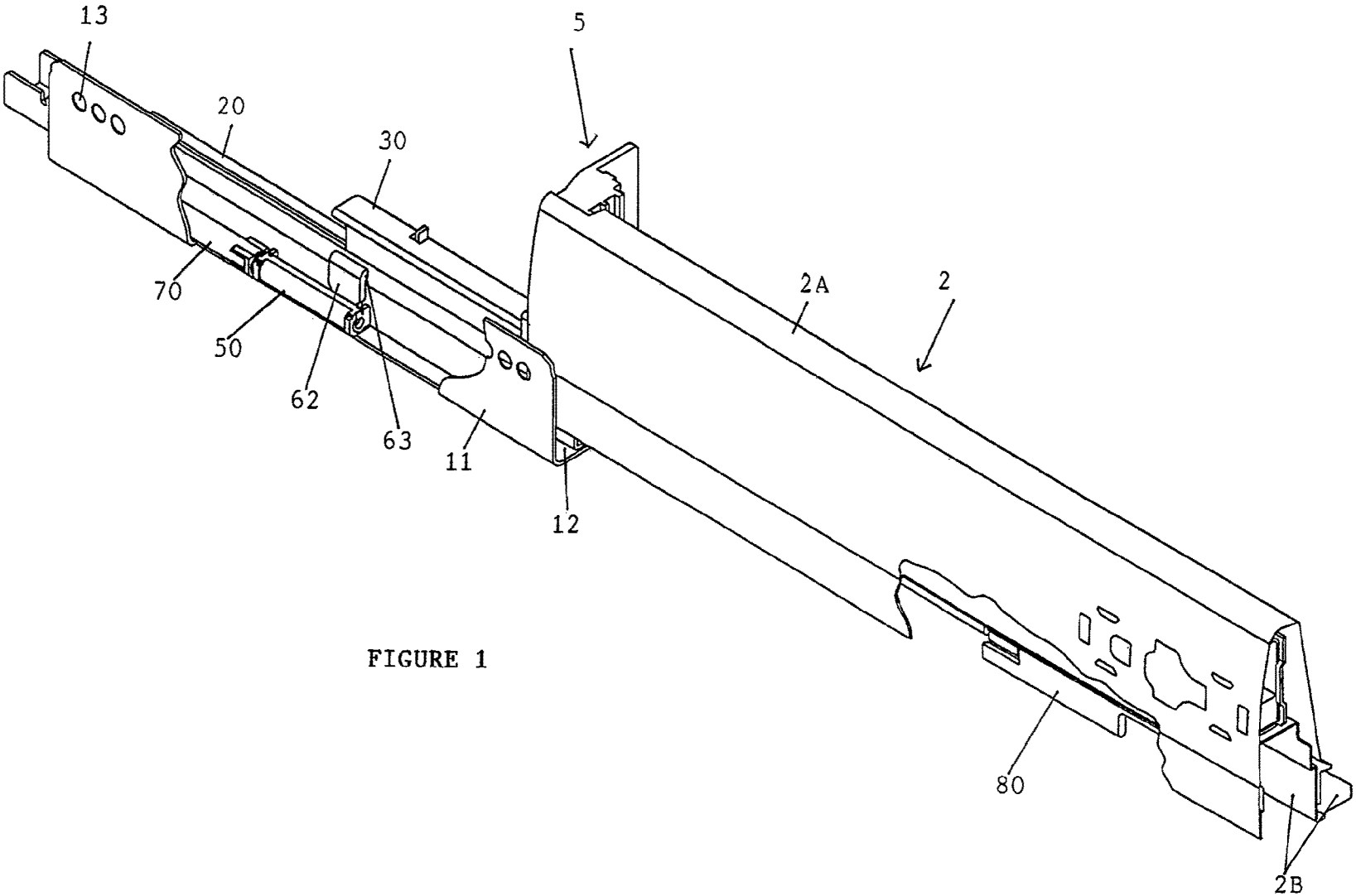
FIG. 1 shows a perspective view of a drawer side member operatively engaged with a sliding guide rail system according to an embodiment of a drawer assembly this invention, in a fully extended position (drawer front, rear and bottom panels not shown).
Figure 2:
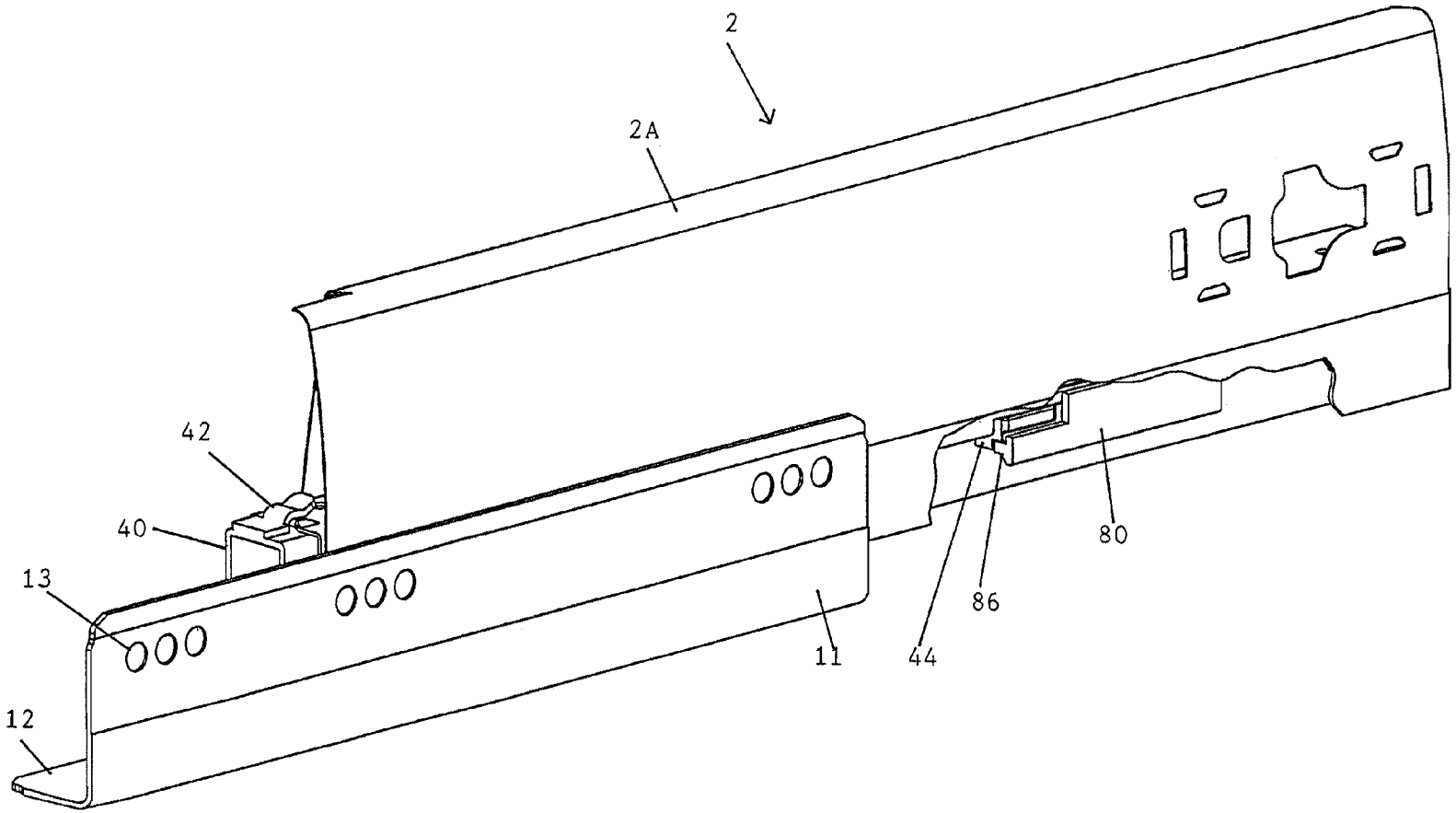
FIG. 2 is a close-up perspective view of the assembly of FIG. 1 in a partially extended position (fixed rail and intermediate rail of guide rail system not shown).

FIGS. 1 to 9 shows an embodiment of a first aspect of a drawer assembly according to the present invention. This drawer assembly comprises of a drawer and a sliding guide rail system for slidably opening and closing the drawer within an article of furniture. The drawer comprises a front panel, rear panel, bottom panel and a drawer side member 2 provided at each side of the drawer (front, rear and bottom panels not illustrated). The guide rail system comprises a mounting bracket 10 for fixing the drawer to the article of furniture, a fixed rail 20 mounted on the mounting bracket 10, an intermediate rail 30 and an outer pull out rail 40 secured to the drawer side member 2. The fixed rail 20 and outer pull out rail 40 each have a slidable housing (not shown) having a plurality of rollers, which enables the intermediate rail 30 to be slidable on the fixed rail 20 and the outer pull out rail 40 to be in turn slidable on the intermediate rail 30. A damping device 70 and a channel guide 50 with sliding member 60 are mounted on and along the mounting bracket 10 adjacent the fixed rail 20. A contact piece 80 that operatively interacts with the sliding member 60 (channel guide 50) and damping device 70 to initiate deceleration of the drawer closing motion is provided on the drawer side member 2.

The drawer front panel, rear panel and bottom panel (not illustrated) may be of normal construction as generally known in the art. The drawer side member 2, as seen in FIGS. 1, 2 and 4 to 6, is of a "double-walled" construction and typically, comprises a cover piece 2A and a support bracket 2B. The cover piece 2A is preferably made of metal and fits over the support bracket 2B. At its rear longitudinal end, the support bracket is provided with an opening (not shown) through which a screw may be inserted for connecting the bracket 2B (drawer side member 2) to the drawer rear panel (not shown) via a corner fitting 5. The support bracket 2B is preferably formed from sheet metal into an open C-section having an L-shaped flange 2C disposed lengthwise along its inner side (side of the bracket 2B facing the inside of the drawer). The drawer bottom panel is mountable onto the horizontal portion of the L-shaped flange 2C such that its side abuts against the vertical portion of the L-shaped flange. The top surface of the support bracket 2B is provided with apertures (not shown), towards its front longitudinal end. The apertures are suitably shaped for receiving a catch (not shown) for removably engaging the support bracket 2B to the guide rail system (outer pull out rail 40). Also provided on the top surface of the bracket 2B, at its front end, is a pair of openings 2D that correspond to the pair of apertures 85 on the drawer side contact piece 80, for receiving screws (or the like). Although not illustrated herein, the contact piece 80 may also be attached to the support bracket by way of clips or any other suitable attachment means.

Figure 6:
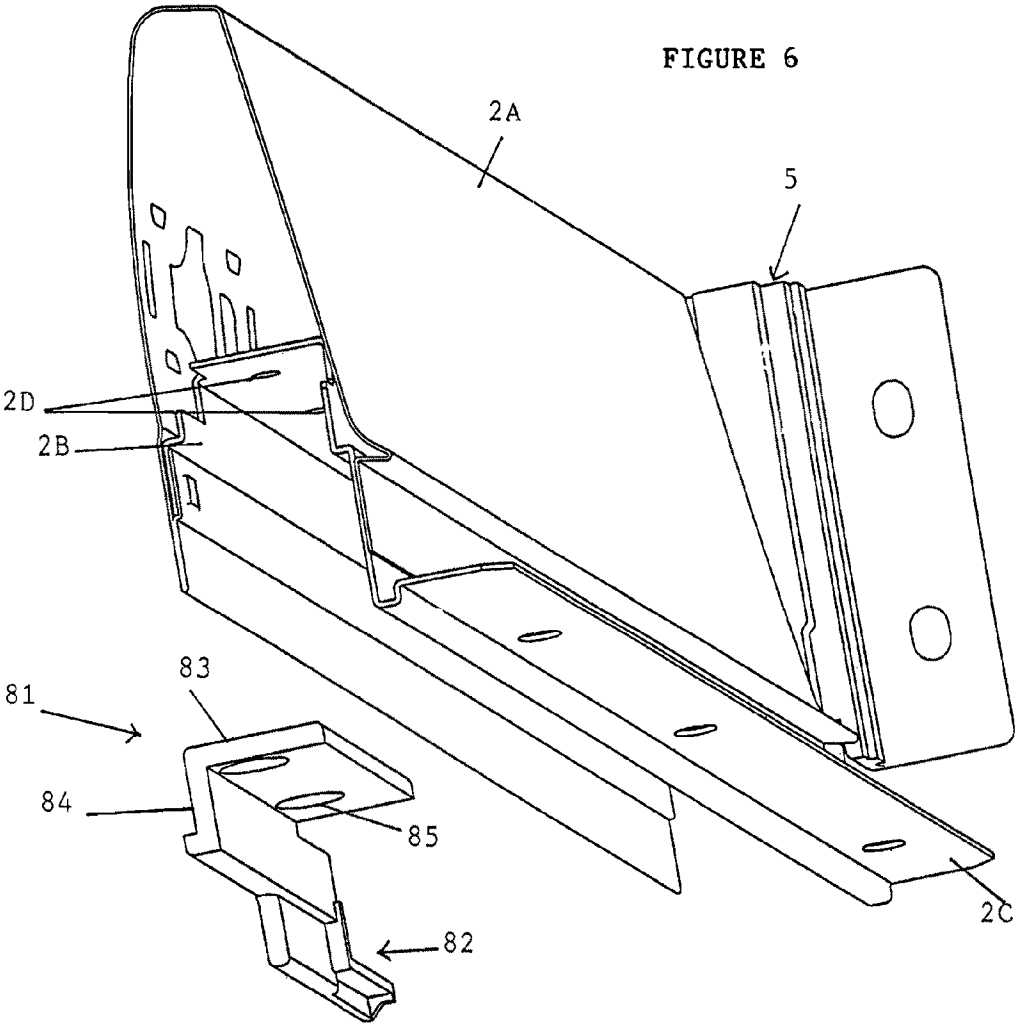
FIG. 6 shows the drawer side contact piece detached from the support bracket bottom surface of the drawer side member of FIG. 1.
Figure 7A:
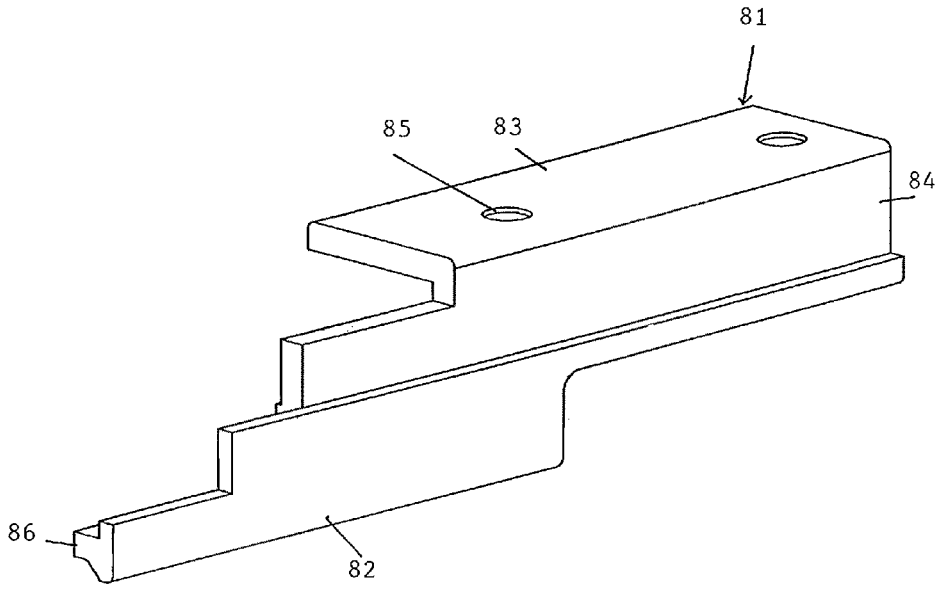
FIGS. 7A and 7B are outer and inner perspective views, respectively, of a drawer side contact piece of the embodiment of FIG. 1.
Figure 7B:
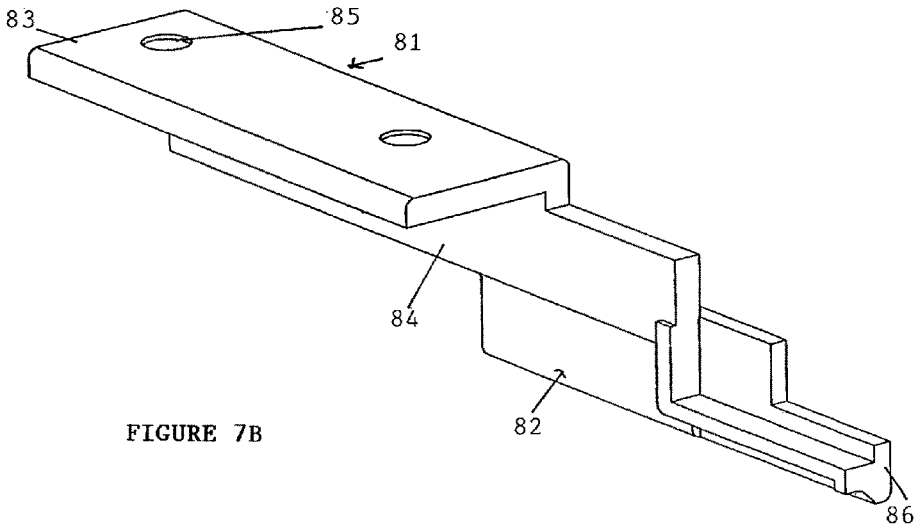

As shown in FIGS. 6 and 7, the drawer side contact piece 80 comprises an attachment part 81 and a downwardly extending contact part 82. The drawer side contact piece may preferably consist of a single piece having attachment and contact parts or possibly two separate pieces, a contact part affixed to an attachment part. The attachment part 81 comprises a horizontal flange 83 and a vertical flange 84, the horizontal flange 83 having two apertures 85 (for receiving screws or the like) that correspond to the pair of openings 2D on the top surface of the drawer side support bracket 2B, for removable attachment of the attachment part 81 (contact piece 80) to the bottom of the support bracket 2B, towards its front longitudinal end. The contact part 82 is affixed to the vertical flange 84 of the attachment part 81 such that it extends toward the rear longitudinal end of the drawer side support bracket 28 (relative to drawer orientation in use). The rear face of the contact part 82 comprises a T-shaped abutment face 86 engageable with the sliding member 60.

FIGS. 1 to 4 shows a mounting bracket 10 of the sliding guide rail system formed from sheet metal into a substantially L-section comprising of a vertical flange 11 and a horizontal flange 12. The vertical flange 11 has a multitude of holes 13 for fixing to the side of an article of furniture such as a cabinet or chassis into which the drawer is to be installed. Stepped edges are also formed on this vertical flange 11 in order to increase its rigidity. Similarly, notches are formed at the bent edge of the L-section for increasing the rigidity and load capacity of this support means. The fixed rail 20 of the guide rail system is attached onto the horizontal flange 12 of the mounting bracket 10. The damping device 70 and channel guide 50 with sliding member 60 are longitudinally mounted on the horizontal flange 12 adjacent the fixed rail 20. Both the damping device 70 and channel guide 50 with sliding member 60 are located longitudinal end to longitudinal end relative to each other with the damping device 70 in a rear position and the channel guide 50 in a front position, both rear and front positions being relative to drawer orientation within the article. Two pairs of punched out metal tabs (not shown) are provided on the vertical flange 11 as means for firmly holding the damping device 70 and channel guide 50. A punched out metal tab with aperture and slots (not shown) is also provided on the horizontal flange 12 of the mounting bracket 10 to aid in firmly holding the damping device 70 and channel guide 50.

The damping device 70 is resiliently compressible in a lengthwise direction and comprises a cylinder body 71 with a rod (not seen) that is pushable into the cylinder body 71 when the device is compressed. The damping device 70 is oriented such that the distal end of the rod is locatable in the sliding member 60 of the channel guide 50. A pair of attachment brackets is provided on the longitudinal ends of the cylinder body 71 with the rear bracket having a protruding tab for engagement with the metal tab and aperture, and the front bracket being engagable with a receiving slot, of the mounting bracket horizontal flange 12. Although, a fluid damper is preferred for use with the assembly of this invention, the damping device 70 may also easily comprise an air damper.

Figure 3:
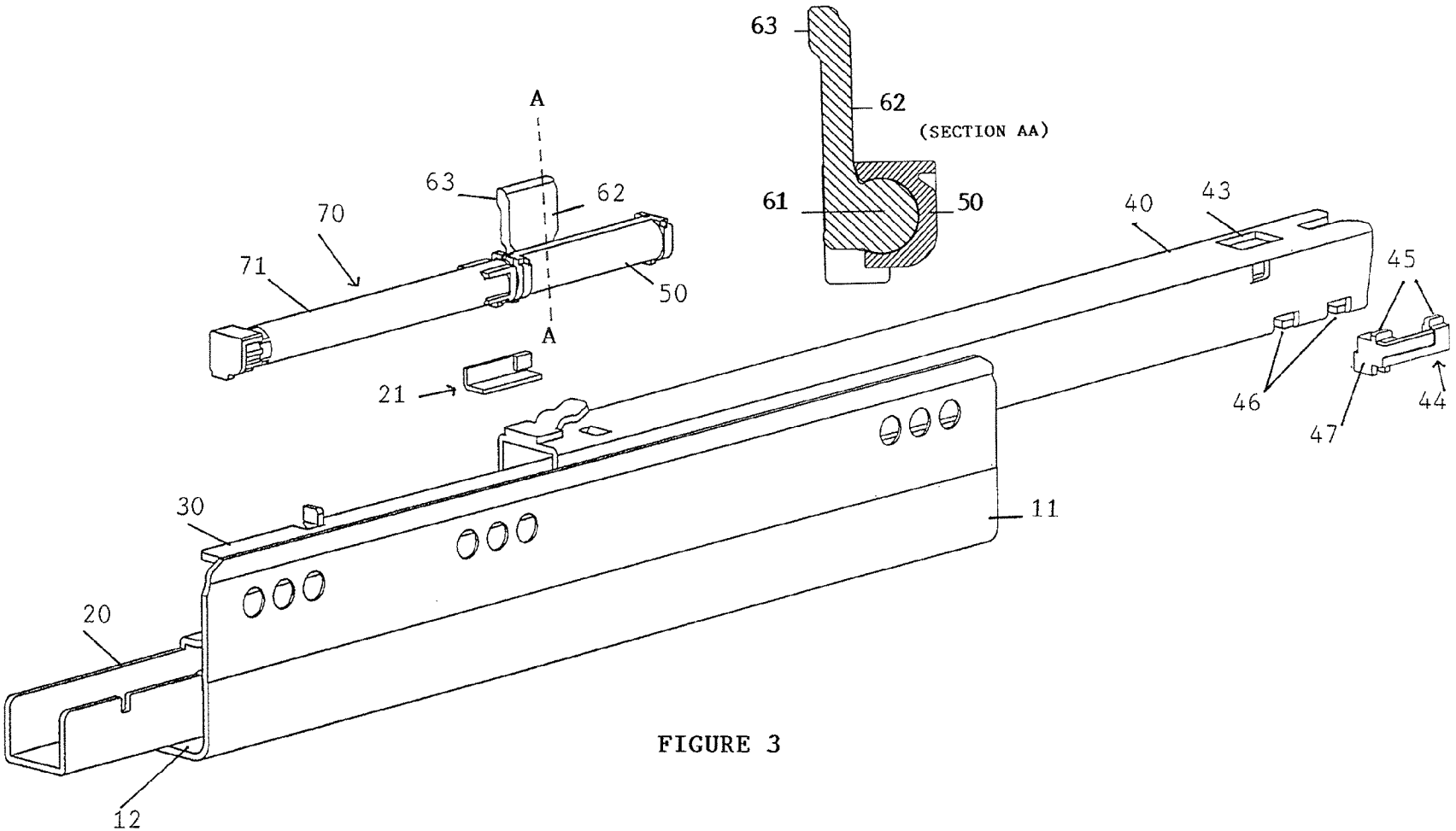
FIG. 3 is an exploded perspective view of the sliding guide rail system in the position of FIG. 2 (drawer side member removed).
Figure 4:
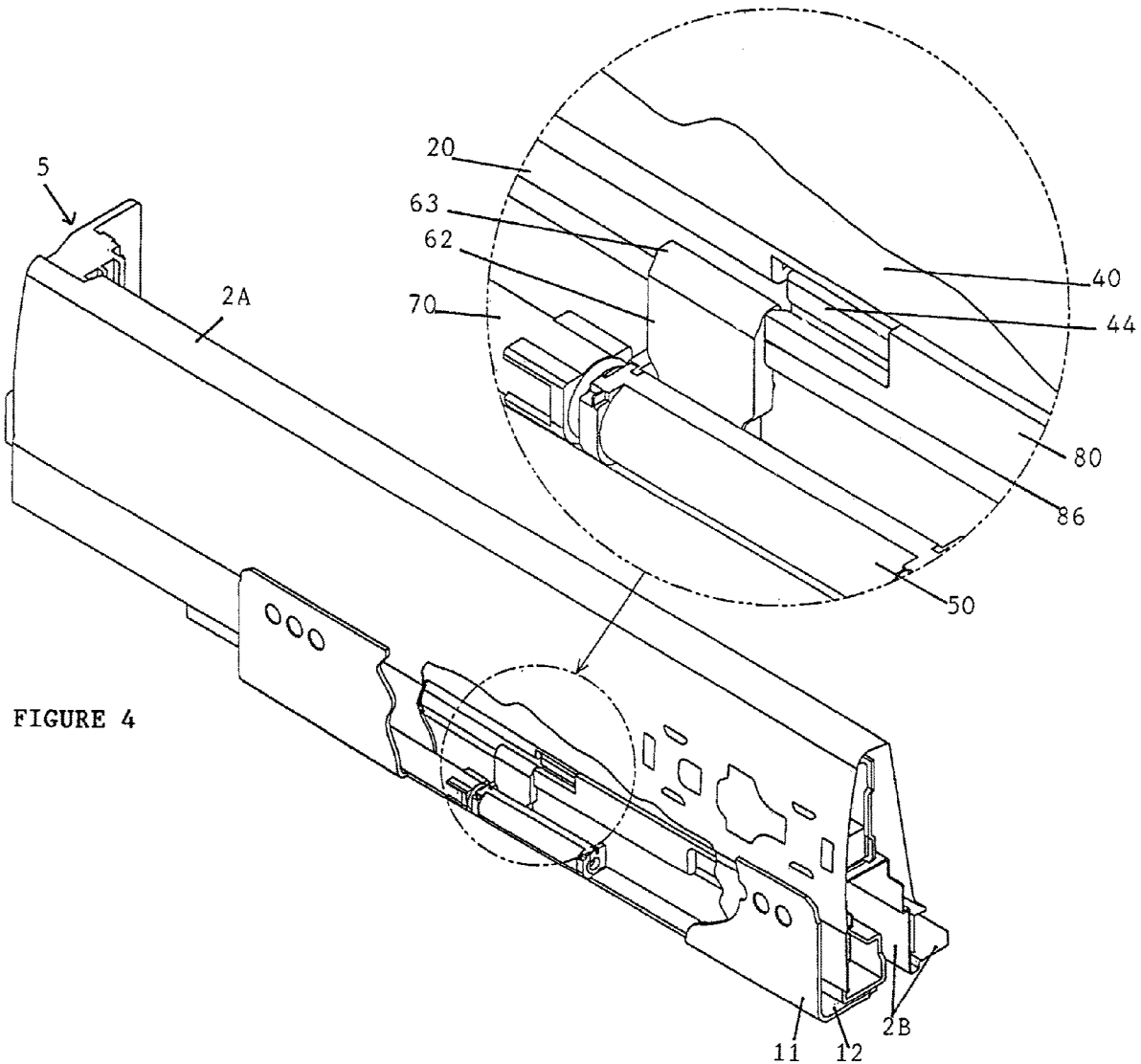
FIG. 4 is an outer perspective view of the assembly of FIG. 1 in a fully retracted position (part of the mounting bracket vertical flange, drawer side member cover piece and support bracket has been removed to show the interaction between the damping device, channel guide, sliding member and drawer side contact piece).
Figure 5:
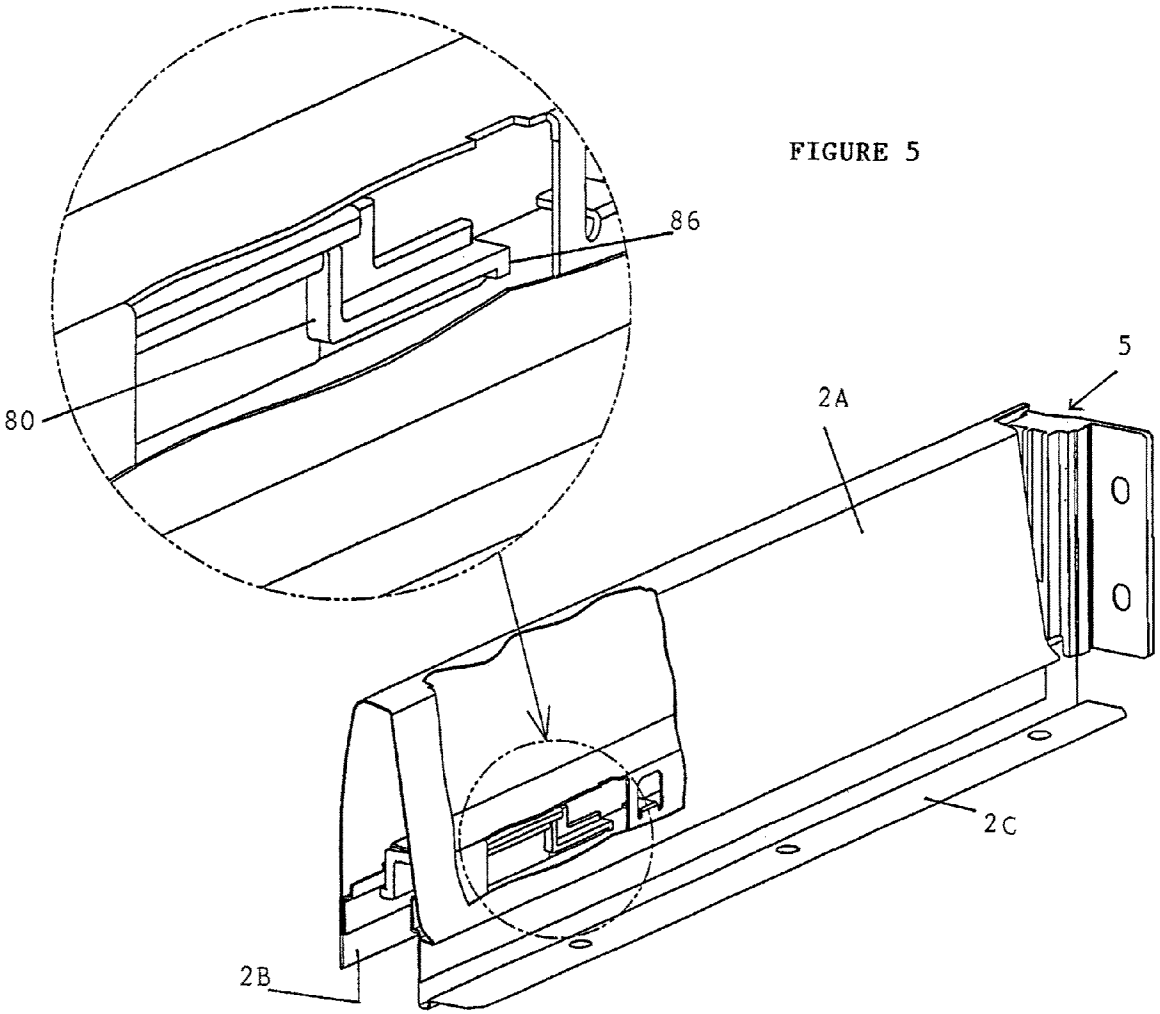
FIG. 5 is an inner perspective view of FIG. 4 (part of the drawer side member cover piece and support bracket has been removed to show the drawer side contact piece).

The channel guide 50, as shown in FIGS. 1, 3 and 4, has a U-shaped channel with an open side and open longitudinal ends. The channel guide 50 is mounted on the mounting bracket 10 in front of the damping device 70 and oriented such that the open side faces toward the adjacent fixed rail 20. The open side of this U-shaped channel is set in from the open longitudinal ends such that a pair of vertical stop faces is defined at each longitudinal end. The bottom portion of these vertical stop faces define a pair of attachment tabs that is engaged into receiving slots (not shown) on the horizontal flange 12 of the mounting bracket 10. A second pair of metal tabs (not shown) on the vertical flange 11 of the mounting bracket 10 contacts the top of the channel guide 50, when punched or pushed inwards, such that the channel guide 50 is caused to be firmly mounted on the mounting bracket 10. A substantially L-shaped sliding member 60 having a horizontally oriented inner portion 61 and a vertically oriented outer portion 62 is slidably mounted within the channel guide 50. The inner portion 61 of the sliding member 60 has a substantially circular cross section and slides within the channel guide 50. The inner portion 61 has a terminal aperture towards the rear open longitudinal end of the channel guide 50 for receiving a distal end of the damping device rod. When fully extended, the damping device rod runs along the inner length of the channel guide 50. The sliding member outer portion 62 extends outwardly through the open side of the channel guide 50 and has an angled terminal end 63 that overhangs an edge of the fixed rail 20. The sliding member 60 is thus, slidable along the fixed rail 20 as well as within the channel guide 50.

The fixed rail 20, seen in FIGS. 1 and 3, is formed from sheet metal into an open C-section. Stops consisting of punched-out tabs that are bent inwardly are formed at either or opposite sides towards the longitudinal ends of the rail 20. Slidably fitted inside this fixed rail 20 is a sliding housing (not shown) having rollers which allows it to run smoothly inside the rail 20 between the stops. The bottom surface of the fixed rail 20 is welded onto the horizontal flange 12 of the mounting bracket 10. A stopper tab 21 is also provided on the upper surface of the fixed rail 20 adjacent the assembled damping device 70-channel guide 50 with sliding member 60. This stopper tab 21 is preferably an L-shaped tab and located at a position on the fixed rail 20 such that the stopper tab 21 is firstly, set back from the rail side edge and secondly, forward relative to the rear travel limit position (at the rear open longitudinal end of the channel guide 50) of the sliding member 60 within the channel guide 50. The position of the stopper tab 21 on the fixed rail 20 defines the rear travel limit of the pull out rail 40.

Figure 10:
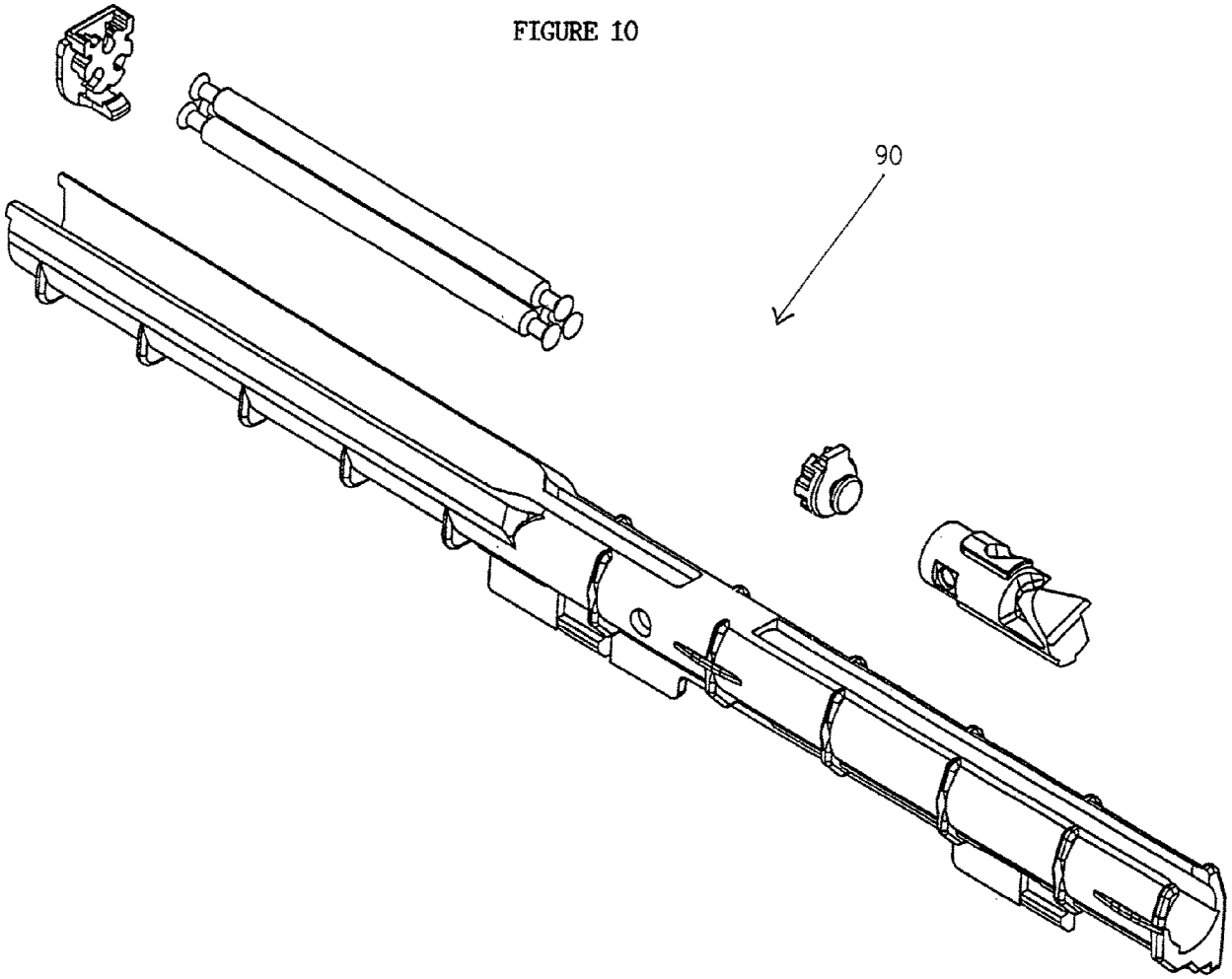
FIG. 10 shows a drawer closing device for use with the drawer assembly of the embodiment of FIG. 1.

Additionally, a drawer closing device 90 is also preferably provided as shown in FIG. 10. This closing device 90 is attached at a rear end of the fixed rail 20 and is engagable with a guiding pin 41 provided on the bottom surface of the outer pull out rail 40 so as to aid in the drawer-closing motion i.e. sliding motion of the pull out rail 40 in a drawer-closing direction.

FIGS. 1 and 3, show the intermediate rail 30 formed from sheet metal into a substantially I-section or alternatively a composite of two Ts with upper and lower horizontal flanges and vertical web. The bent edges of the upper and lower flanges are either on the same side as each other or at opposite sides. Two pairs of stops are formed spaced apart on the upper and lower surfaces of the lower and upper flanges respectively that may again consist of inwardly bent punched-out tabs. This intermediate rail 30 may be installed with no distinction as to which end is forward. Also, this rail 30 may be provided with the punched-out tabs of stops not yet bent so that these tabs may be bent in the required direction during assembly or installation. This would allow for flexibility during assembly of this system and also advantageously reduces the number of parts required for stocking.

Also seen in FIG. 3 is the outer pull-out rail 40 formed from a sheet metal into an open C-section. On either side of this pull out rail 40 are two stops disposed such that each stop is located towards a longitudinal end of the rail 40. These stops consist of punched-out tabs that bend inwardly. An L-shaped extension 42 is cut or formed on the upper surface of this pull out rail 40. This extension 42 engages with an attachment (not shown) on the drawer side member 2 for fixing the pull out rail 40 to the drawer. An aperture 43 is also punched on the upper surface of this pull out rail 40 at the front end (relative to drawer orientation) to allow for engagement with a catch (not shown) mounted at the front of the drawer side member 2. This allows for the drawer to be easily and removably attached with the outer pull out rail 40. Slidably fitted inside this pull out rail 40 is a sliding housing (not shown) having rollers which allows it to run smoothly inside the pull out rail 40 between the stops. A guiding pin 41 for engagement with the drawer closing device 90 at the rear end of the fixed rail 20 is provided on the bottom surface of the pull out rail 40.

Additionally, as seen in FIG. 3, this outer pull out rail 40 has a stopper piece 44 on its bottom surface disposed toward its front end (relative to drawer orientation). The stopper piece 44 is preferably removably mounted on the bottom surface of the rail 40. In this embodiment, the stopper piece 44 has a pair of attachment tabs 45 on its top and the bottom surface at a front end of the pull out rail 40 has a pair of corresponding apertures 46 for receiving the stopper piece attachment tabs 45. The stopper piece 44 is a substantially rectangular block with its rear longitudinal end comprising an abutment surface 47. The abutment surface 47 is engagable with the fixed rail stopper tab 21. Engagement of the abutment surface 47 of the stopper piece 44 with the stopper tab 21 defines the rear travel limit of the pull out rail 40.

The sliding housings (not shown) of both the fixed rail 20 and outer pull out rail 40 are of a similar construction and comprise a long member having a substantially rectangular cross-section with a hollow central recess in the form of an open T.

Rollers are provided at the upper part and both sides of the T. The side rollers are vertically displaced by a distance substantially equal to the thickness of the vertical web of the intermediate rail 30. The number, type (whether upper or side rollers) and configuration of rollers depend on the load capacity for which the sliding housings are designed. Further side rollers (not shown) that provide lateral guidance for the drawer/equipment may also be provided, wherein when these rollers are spaced as far apart as possible, greater lateral stability is provided. The open T-shaped recess of the intermediate rail-sliding housing enables the intermediate rail 30 to be slidable on the fixed rail 20 with the lower flange of the rail slidably fitted therein. Similarly, the open T-shaped recess of the outer pull out rail-sliding housing enables the pull out rail 40 to be slidable on the intermediate rail 30 with the upper flange of the rail slidably fitted therein. Adequate clearances are provided between the upper rollers and the respective contact surfaces of both the upper and lower flanges of the intermediate rail 30 for ease of alignment and/or assembly. Similarly, adequate clearances are provided between side rollers and the contact surfaces of the vertical web of the intermediate rail 30.

Figure 8:
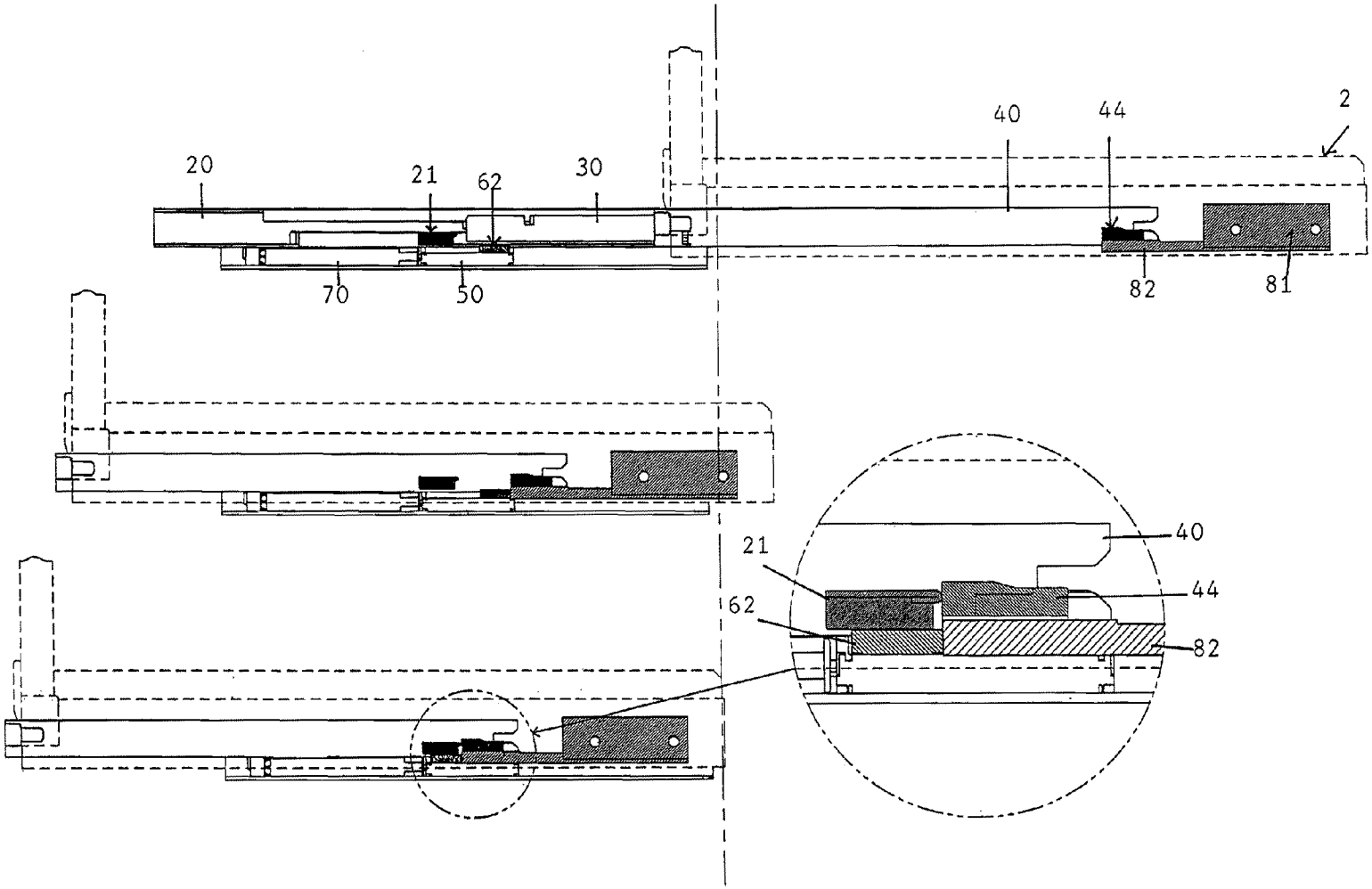
FIG. 8 shows a top view of the assembly of the embodiment of FIG. 1 as the drawer is initially in a fully opened position and subsequently pushed into a fully closed position.
Figure 9:
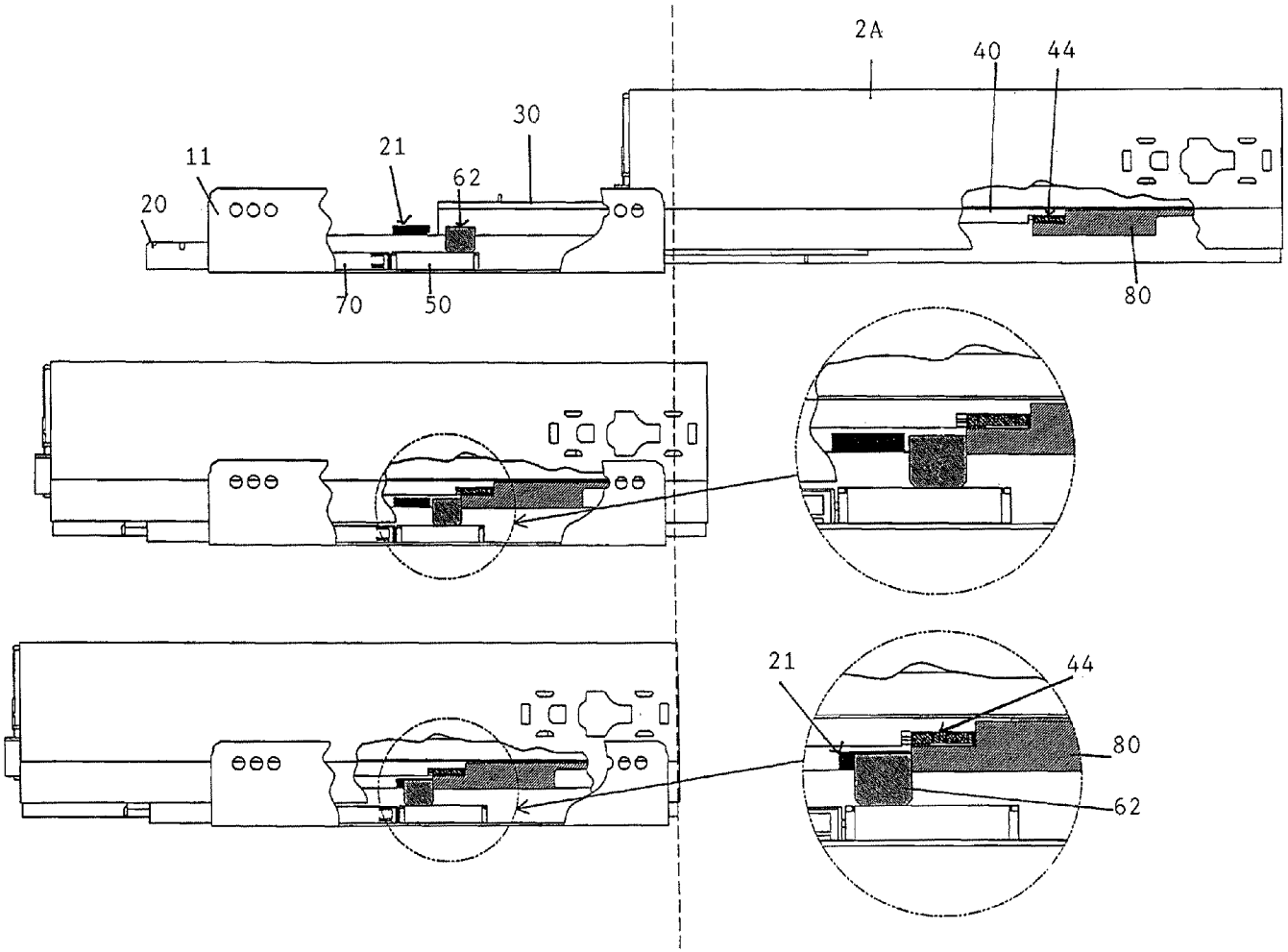
FIG. 9 is a side view of FIG. 8.

In use, as shown in FIGS. 1, 8 and 9, when the drawer is in a fully extended position, the outer pull out rail 40 of the guide rail system is in a fully extended position and the sliding member 60 within the channel guide 50 is at its front travel limit abutting against the front vertical stop face of the channel guide 50. In this state, the rod of the damping device 70 with its distal end located within the sliding member inner portion 61 extends along the inner length of the channel guide 50. The outer pull out rail 40 (and attached drawer side member 2) is caused to slide in a drawer-closing direction as the drawer is pushed in. Subsequently, the drawer side contact piece 80 engages the angled terminal end 63 of the sliding member outer portion 62 via its T-shaped abutment face 86. At the same time, the guiding pin 41 of the pull out rail 40 engages the drawer closing device 90. In this state, the closing action of the guide rail system (and drawer) is aided by the action of the drawer closing device 90. Engagement of the drawer side contact piece abutment face 86 with the angled terminal end 63 of the sliding member outer portion 62 urges the sliding member inner portion 61 to slidably travel within the channel guide 50. The sliding motion of the sliding member inner portion 61 in turn, causes the damping device 70 to be compressed in a lengthwise direction as the damping device rod located within the inner portion 61 of the sliding member 60 is pushed into the cylinder body 71. Thus, the sliding motion of the sliding member 60 against the resilience of the damping device 70 will result in the deceleration of the drawer-closing motion.

The outer pull out rail 40 and attached drawer side member 2 having its contact piece 80 engaged with the sliding member 60 of the channel guide 50 continues to slide inward until the drawer is fully closed. The pull out rail 40 sliding motion is halted at its rear travel limit as the abutment surface 47 of its stopper piece 44 engages the stopper tab 21 of the fixed rail 20. In this position, the pull out rail 40 is said to be at its rear travel limit. As the fixed rail stopper tab 21 is set back from the rail side edge, the sliding member 60 continues to be slidable within the channel guide 50 even though the pull out rail 40 is at its rear travel limit and as such, stationary. The sliding motion of the sliding member 60 within the channel guide 50 is limited by the inner length of the channel guide 50. In other words, the front vertical stop face of the channel guide 50 defines a front travel limit for the sliding member and the rear vertical stop face defines a rear travel limit.

When the drawer is in a fully closed or pushed-in position, the outer pull out rail 40 of the guide rail system is at its rear travel limit with the abutment surface 47 of its stopper piece 44 engaged with the fixed rail stopper tab 21 and its guiding pin 41 engaged with the drawer closing device 90. The damping device 70 is in a compressed state (majority length of the rod with its distal end located within the sliding member inner portion 61 pushed into cylinder body 71) and the angled terminal end 63 of the sliding member outer portion 62 is engaged with the abutment face 86 of the drawer side contact piece 80. As the drawer is pulled out, the outer pull out rail 40 (with attached drawer side member 2) is caused to slide in a drawer-opening direction resulting in the pull out rail guiding pin 41 being disengaged from the drawer closing device 90 and the abutment face 86 of the drawer side contact piece 80 being disengaged from the angled terminal end 63 of the sliding member outer portion 62. The damping device 70 will now be allowed to decompress in a lengthwise direction due to its resilient nature and the rod will be pushed out of its cylinder body 71. As the distal end of the rod is located within the sliding member inner portion 61, decompression of the damping device 70 will urge the forward sliding motion of the sliding member 60 within the channel guide 50 until it reaches its front travel limit.

In another aspect of this invention as seen in FIGS. 11 to 17, construction of the drawer front panel 1 and rear panel 3, outer pull rail sliding housings and damping device 700 of the guide rail system and manner of attachment to an article of furniture are similar to the above-described first aspect. Construction of the drawer side member 2 and bottom panel 4, mounting bracket 100, fixed rail 200, intermediate rail 300, outer pull out rail 400 and its stopper piece 440 and channel guide 500 with sliding member 600 of this aspect differs from that of the first aspect.

As opposed to the first aspect, the drawer side member 2 in this aspect comprises a single panel. A contact piece 800 is removably attached to the bottom of each front corner (relative to drawer orientation in use) of drawer bottom panel 4. The contact piece 800 may comprise any drawer element attached to the drawer bottom panel 4, at its front corner, having a contact part 820 that projects in a rearwardly direction (relative to drawer orientation in use) so as to be engageable with the sliding member 600. In the preferred embodiment illustrated herein (FIGS. 11 to 13, 16 and 17), the drawer bottom contact piece 800 comprises an engagement means for releasably engaging the drawer (drawer bottom panel 4) with the guide rail system (outer pull out rail 400). The engagement means comprises an attachment part 810 and a contact part 820, which may preferably consist of a single piece or possibly two separate pieces i.e. a contact part affixed to an attachment part. The attachment part 810 is provided with two apertures (for receiving screws or the like) for removable attachment at a front corner of the drawer bottom panel 4. The contact part 820 is affixed to the attachment part 810 such that it extends downwardly from the attachment part and has a rearwardly projecting arm 830 (relative to drawer orientation in use). The terminal end of the contact part arm 830 comprises an abutment face 840 engageable with the sliding member 600.

Figure 11:
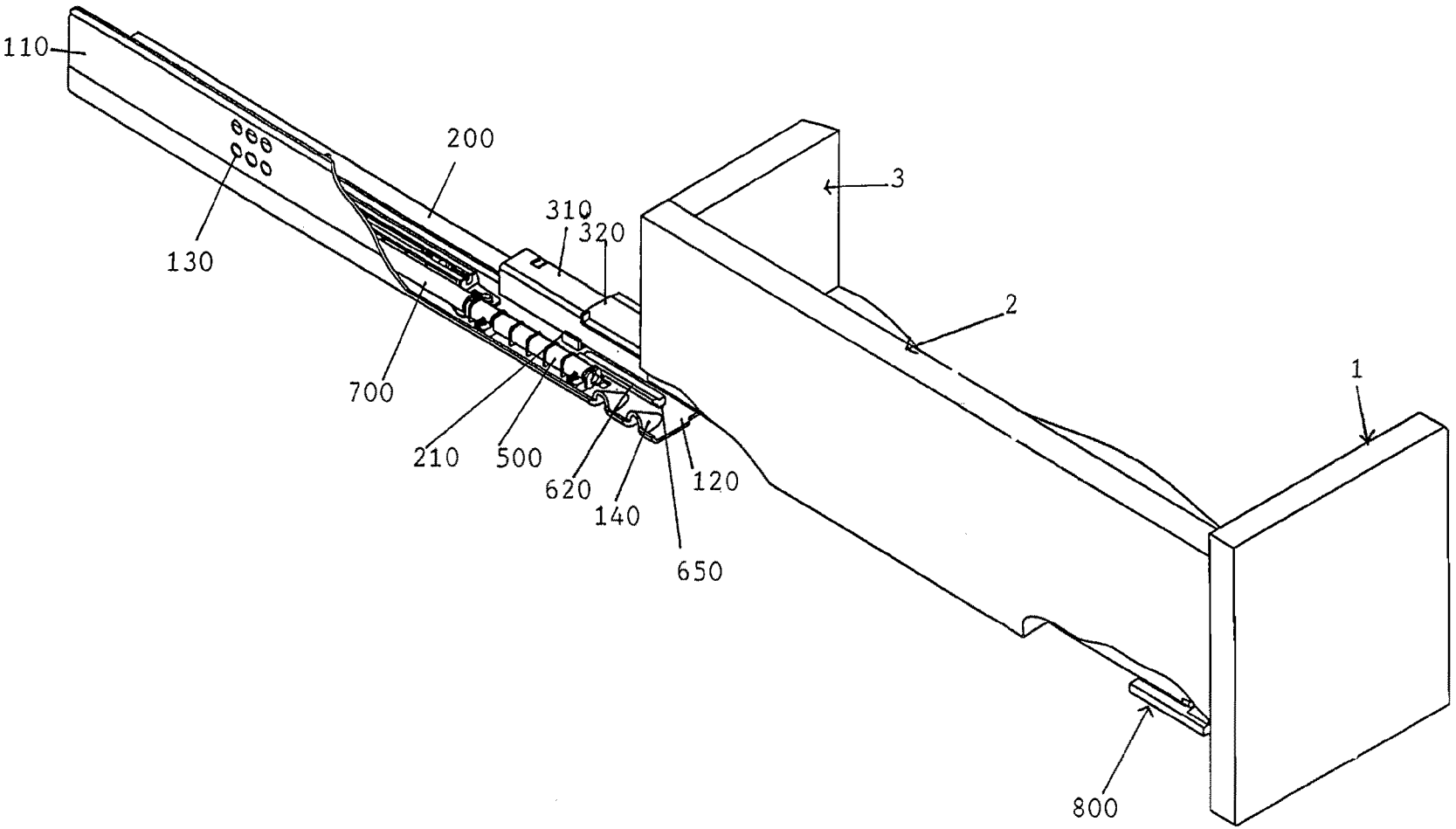
FIG. 11 shows a perspective view of a sliding guide rail system operatively engaged with a drawer bottom panel according to another embodiment of a drawer assembly this invention, in a fully extended position (part of the mounting bracket vertical flange and part of the drawer is removed to show the damping device, channel guide, sliding member and drawer bottom contact piece).
Figure 12:
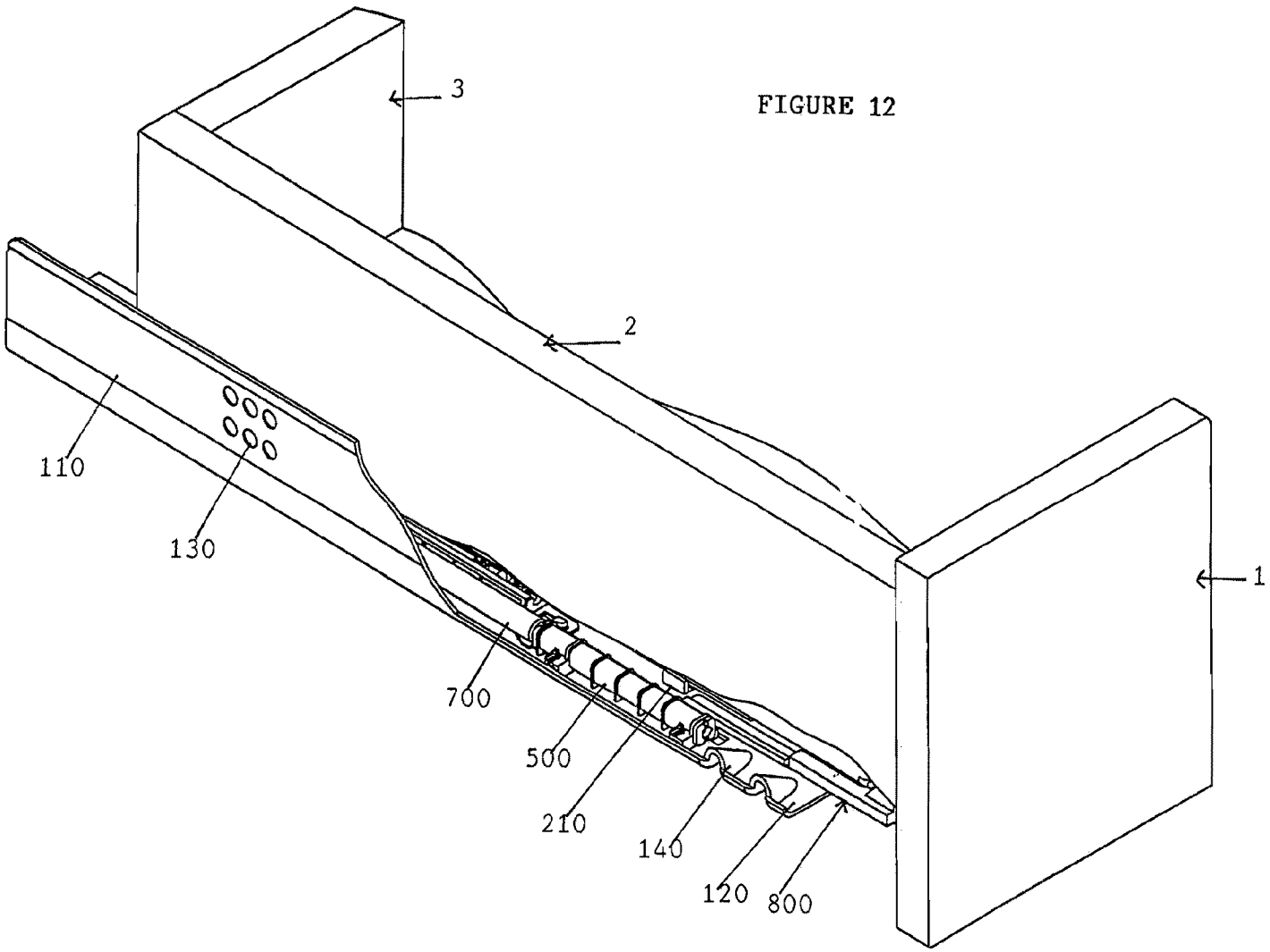
FIG. 12 is a perspective view of the assembly of FIG. 11 in a partially retracted position (part of the mounting bracket vertical flange and drawer side and bottom panels have been removed to show the interaction between the damping device, channel guide, sliding member and drawer bottom contact piece).
Figure 13:
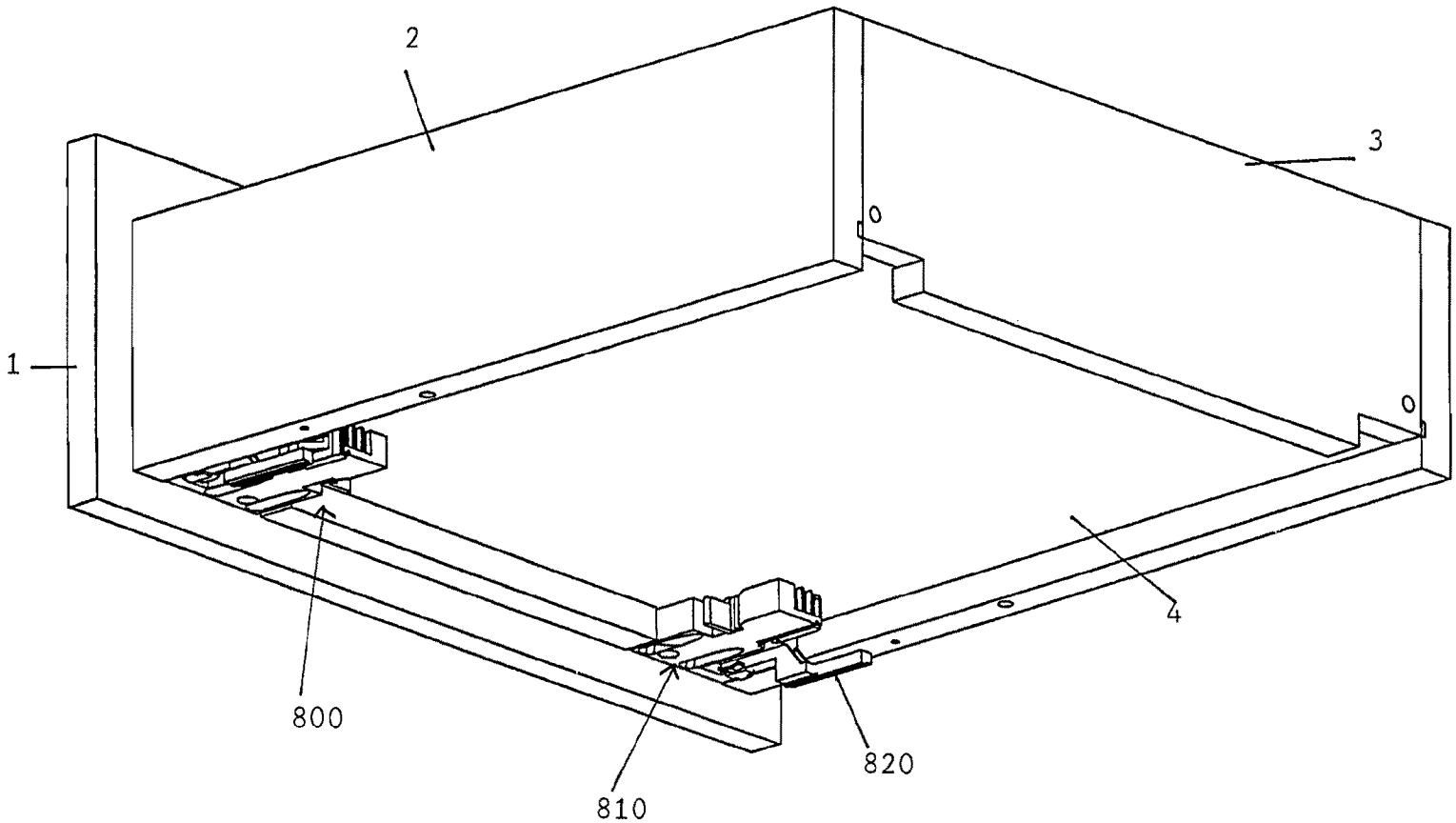
FIG. 13 is a bottom view of FIG. 12 showing the location of the drawer bottom contact piece relative to the drawer front panel.
Figure 14:
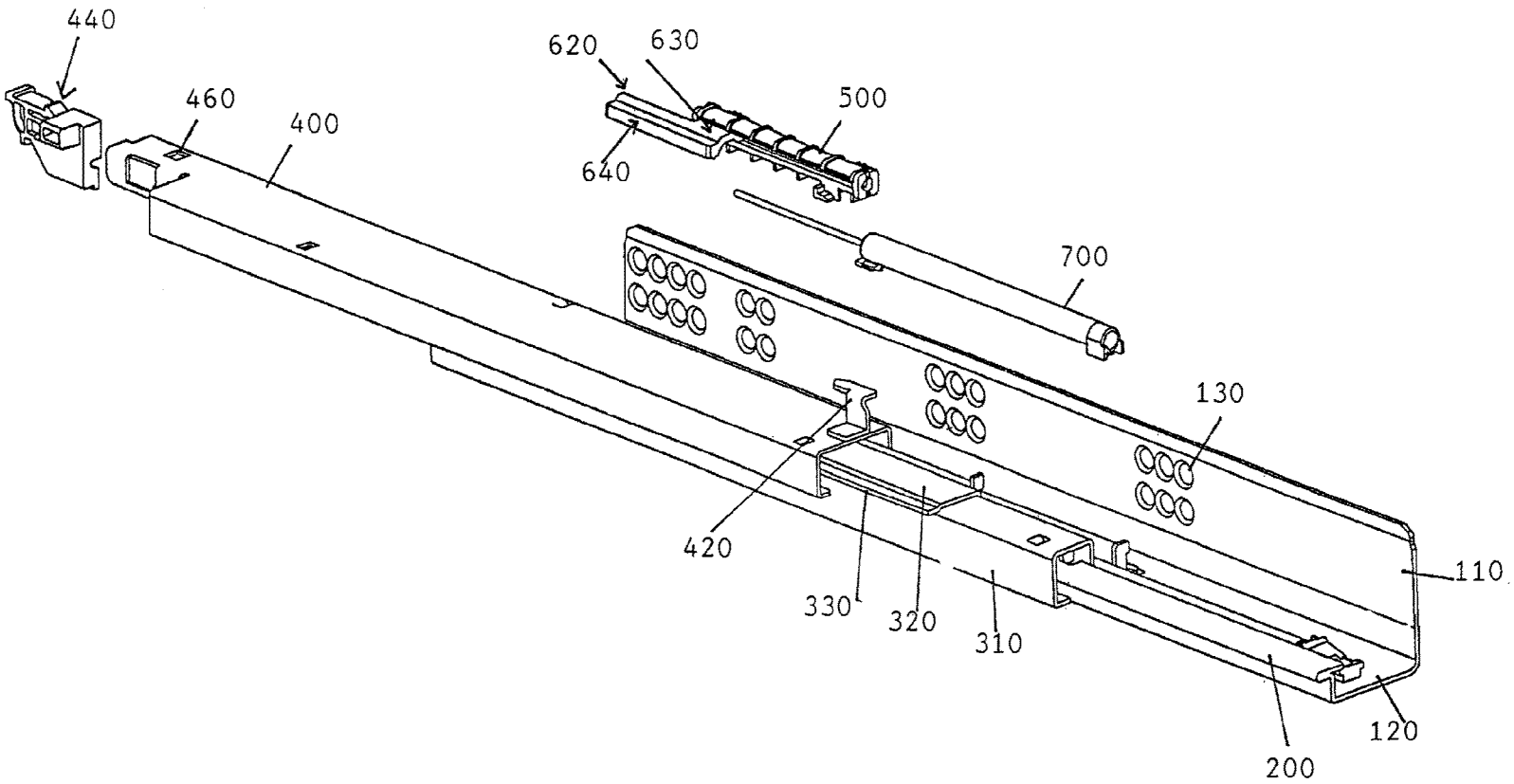
FIG. 14 is an exploded view of the sliding guide rail system for use in the embodiment of FIG. 11.
Figure 15A:
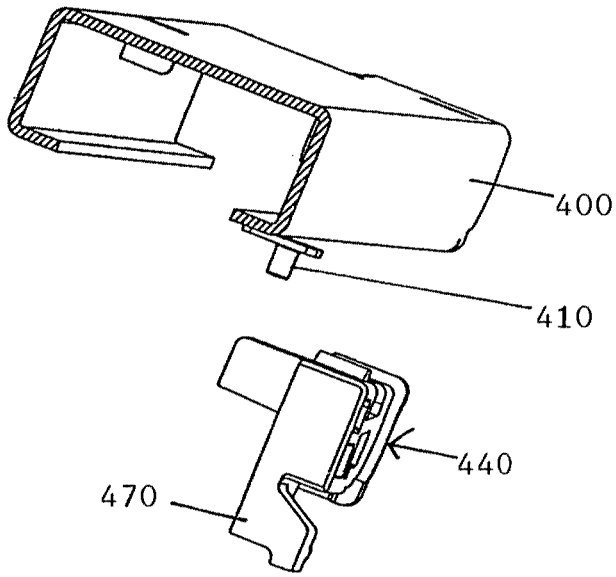
FIG. 15A shows the stopper contact piece detached from the bottom surface of the outer pull out rail of FIG. 14.
Figure 15B:
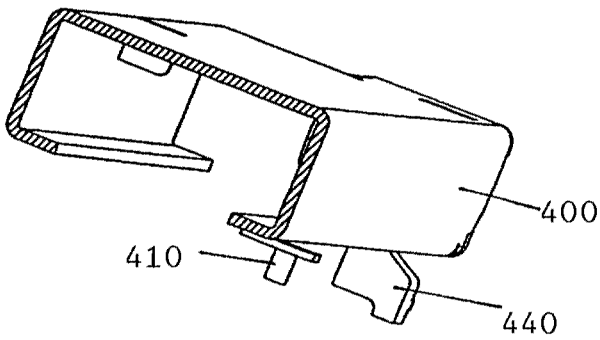
FIG. 15B shows the stopper contact piece removably assembled within the outer pull out rail of FIG. 14.
Figure 15C:
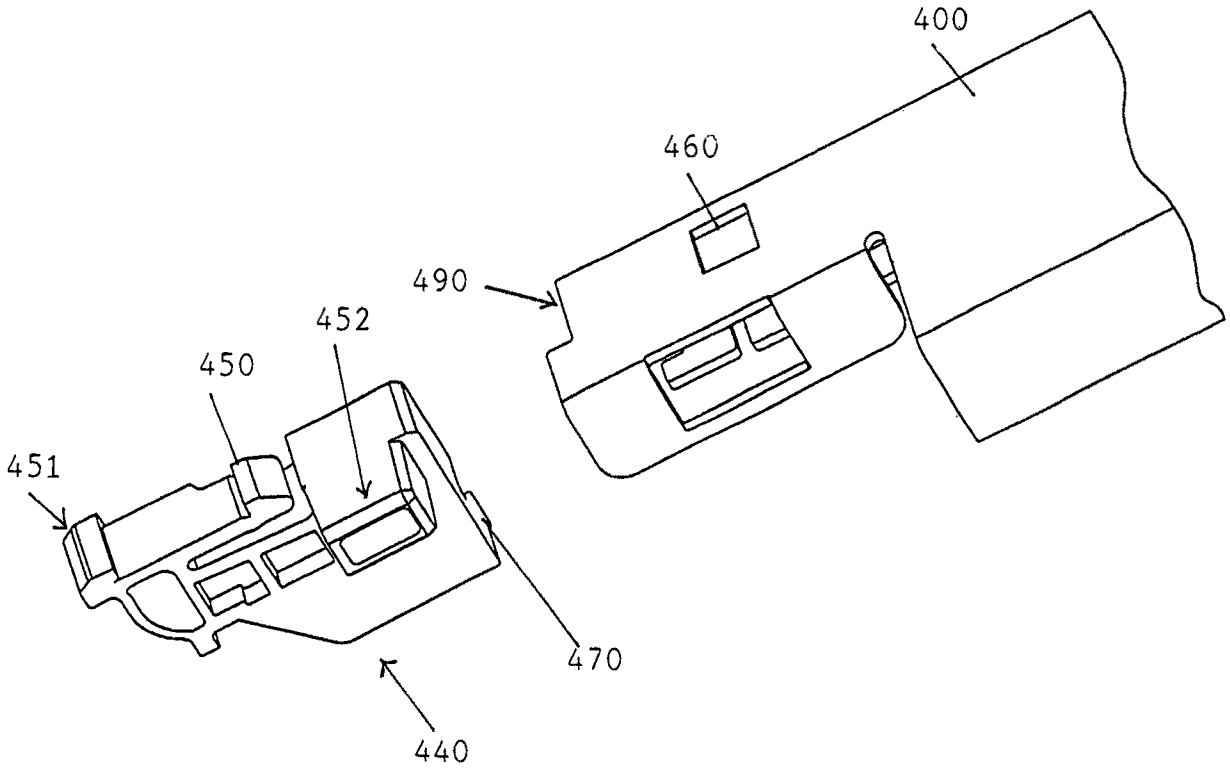
FIG. 15C shows a top perspective view of FIG. 15A.

As shown in FIGS. 11, 12 and 14, the mounting bracket 100 of this aspect is formed from sheet metal into an L-section with the upper free edge of the horizontal flange 120 of the L-section bent upwardly to form a fixed rail 200 having a T-cross section. The height of the fixed rail 200 is significantly less than the height of the vertical flange 110 of the L-section mounting bracket 100. The T-shaped fixed rail 200 also has a folded up metal tab at its rear longitudinal end (relative to drawer orientation) that functions as a limit stopper for the sliding housing (as described above) that slides thereon. As in the first aspect, the vertical flange 110 of the mounting bracket 100 is provided with a multitude of holes 130 for fixing to the side of an article of furniture. Similarly, the vertical flange 110 has stepped edges formed thereon and notches at the bent edge of the L-section for increasing the rigidity and load capacity of this mounting bracket 100. The damping device 700 and channel guide 500 with sliding member 600 are longitudinally mounted on the horizontal flange 120 of the mounting bracket 100 adjacent the fixed rail 200.

Both the damping device 700 and channel guide 500 with sliding member 600 are located longitudinal end to longitudinal end relative to each other with the damping device 700 in a rear position and the channel guide 500 in a front position, both rear and front positions being relative to drawer orientation within the article. A pair of apertures with retainer pieces (not shown) is provided on the horizontal flange 120 of the L-section for firmly holding the channel guide 500 thereon. For holding the damping device 700 on the horizontal flange 120, a similar aperture with retainer piece (not shown) is also provided together with a retaining hole and tab.

A stopper tab 210 is also provided on the horizontal flange 120 of the L-section adjacent and between the channel guide 500 and T-shaped fixed rail 200. The stopper tab 210 is located such that it is forward relative to the rear travel limit position of the sliding member 600 within the channel guide 500.

Figure 18:
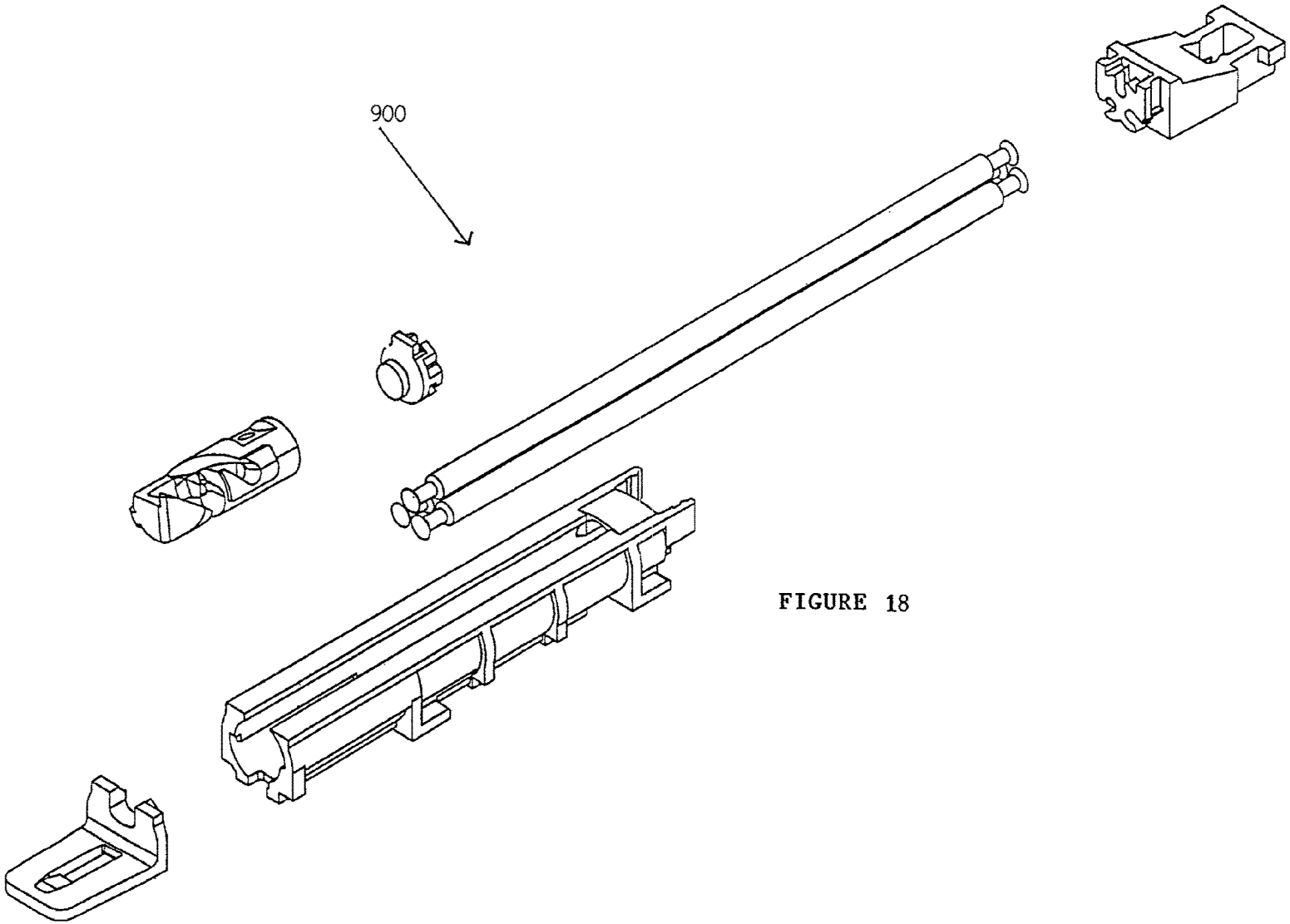
FIG. 18 shows a drawer closing device for use with the drawer assembly of the embodiment of FIG. 11.

In this aspect, a drawer closing device 900, as shown in FIG. 18, is preferably provided on the mounting bracket horizontal flange 120 between its vertical flange 110 and the longitudinal arrangement of the damping device 700 and channel guide 500. Similarly as in the first aspect, the closing device 900 aids in the drawer-closing motion i.e. sliding motion of the pull out rail 400 in a drawer-closing direction.

The damping device 700 of this aspect is substantially similar to that of the first aspect with several exceptions. A pair of attachment brackets is provided on the longitudinal ends of the cylinder body 710 with the rear bracket having two extensions for engagement with the corresponding retaining tab, and the front bracket being engagable with a corresponding receiving aperture, of the mounting bracket horizontal flange 120. Although, a fluid damper is preferred for use with the assembly of this invention, the damping device 700 may also easily comprise an air damper.

In this aspect, as seen in FIGS. 11, 12 and 14, the channel guide 500 is a C-shaped housing having longitudinally open ends 510. A lengthwise slot 520 is provided on a side of the channel guide housing. The channel guide 500 is mounted on the mounting bracket horizontal flange 120 in front of the damping device 700 and oriented such that the slot 520 is disposed towards the adjacent fixed rail 200. A pair of attachment tabs provided adjacent the longitudinal ends of the channel guide 500 is engaged into the corresponding receiving apertures on the horizontal flange 120 of the mounting bracket 100. The channel guide 500 is thus, firmly mounted on the mounting bracket 100.

The sliding member 600 having an inner 610 and an outer portion 620 is slidably mounted within the channel guide 500. The inner portion 610 of the sliding member 600 has a substantially circular cross section and slides within the channel guide 500. It is provided with a terminal aperture towards the rear open longitudinal end 510 of the channel guide 500 for receiving a distal end of the damping device rod.

When fully extended, the damping device rod runs along the inner length of the channel guide 500. The front travel limit of the sliding member 600 within the channel guide 500 is defined by the front longitudinal end of the channel guide slot 520 and its rear travel limit by the rear longitudinal end of the slot 520.

In a preferred embodiment, as seen in FIG. 14, the sliding member outer portion 620 is substantially L-shaped with the foot 630 of the L extending sidewardly through the lengthwise slot 520 of the channel guide 500 and the leg 640 of the L disposed parallel with and adjacent to the mounting bracket fixed rail 200. A terminal abutment surface 650 contactable by the drawer bottom contact piece 800 is provided on the front face of the leg 640 of the L-shaped outer portion. The leg 640 of the L-shaped outer portion 620 is of substantially longer length relative to the length of the channel guide 500. A support tab 150 is provided on the mounting bracket horizontal flange 120 towards its front longitudinal end (relative to drawer orientation) adjacent the leg 640 of the L-shaped outer portion 620. This support tab 150 prevents the leg 640 of the L-shaped outer portion 620 from being shifted laterally as the terminal abutment face 650 of the outer portion 620 is engaged by the drawer bottom contact piece 800. Stabilizer protrusion means (not shown) is provided on the bottom face of the sliding member outer portion 620 so as to enable its movement to be supported by the top surface of the mounting bracket horizontal flange 120. The stabilizer protrusion means may comprise either single or multiple pieces.

In other embodiments of this aspect (not illustrated), the sliding member outer portion 620 may also be of relatively short length in comparison with the length of the channel guide 500. Sliding member outer portions 620 of differing lengths is due to the need to cater for drawers designed for either heavy loading or light (normal) loading. When in use, the mounting bracket 100 bears the whole weight of the drawer load. The fixed rail 200 will be subjected to tremendous load force when a drawer is heavily loaded. Hence, in guide rail systems designed for heavy-load drawers, several strengthening corner settings 140 are added at the adjoining portion of the vertical 110 and horizontal flanges 120 of the mounting bracket 100. This necessitates locating the damping device 700—channel guide 500 (sliding member 600) configuration away from the front longitudinal end of the mounting bracket horizontal flange 120, as described in the above preferred embodiment seen in FIG. 14, thus, the need for a sliding member outer portion 620 of a longer length in order to allow for contact with the drawer bottom contact piece 800.

For guide rail systems designed for light (or normal) load drawers, strengthening corner settings at the adjoining portion of the horizontal 120 and vertical flanges 110 of the mounting bracket 100 will not be needed i.e. the damping device 700-channel guide 500 (sliding member 600) configuration may be located adjacent the front longitudinal end of the mounting bracket horizontal flange 120. Thus, a sliding outer portion 620 of a shorter length would be sufficient (engageable with drawer bottom contact piece 800). The embodiment seen in FIG. 14 is preferred since it is adaptable for use with both a heavy-load and light (normal) load drawer.

The intermediate rail 300 of this aspect seen in FIGS. 11 and 14 consists of an open C-shaped guide 310 having unequal sides that is slidable along the mounting bracket fixed rail 200 and a channel piece 320 disposed on top of the C-shaped guide 310. At the upper and rear ends of each side of the C-shaped guide 310 is a punched out tab (not shown) that extends inwards and serves as a travel limit stopper for the fixed rail sliding housing (not shown). The channel piece 320 is preferably a substantially planar metal plate that is detachably mounted on top of the C-shaped guide 310 and slidably receives the outer pull out rail 400 thereon. Also, the channel piece 320 has a step on each side, thereby defining a shoulder 330 on each side of the channel piece 320, for guiding and stabilizing the sliding motion of the outer pull out rail 400. The width of this channel piece 320 is therefore, preferably considerably more than that of the C-shaped guide 310 but slightly less than that of the outer pull out rail 400. A punched out tab functioning as a limit stopper for the sliding housing of the outer pull out rail 400 is also provided at the upper end of the channel piece 320.

As seen in FIGS. 11, 14 and 15A to 15C, the outer pull out rail 400 of this aspect is of a similar construction and function as that described in the first aspect with several exceptions. In this aspect, one side of the front longitudinal end of this pull out rail 400 comprises an open space 480 formed by bending a side portion of the rail top surface downwards. A cut-in recess 490 is provided on the other side of the pull out rail front end. An opening 460 is provided on the top surface of the rail 400, adjacent the bent-down portion, for receiving a resilient attachment tab 450 of the stopper piece 440 which will be described below. Also, the L-shaped extension 420 on the upper surface of the pull out rail 400 engages with an aperture at the back of the drawer (not shown) for fixing this pull out rail 400 to the drawer. An aperture is also punched on the side of this pull out rail 400 at the front end (relative to drawer orientation) to allow for engagement with a catch (not shown) mounted on the bottom of the drawer i.e. the guide rail system of this aspect is designed as "an undermount system". This allows for the drawer to be easily and removably attached with the outer pull out rail 400. Similarly as in the first aspect, a sliding housing having rollers is slidably fitted inside the pull out rail 400. A guiding pin 410 for engagement with the drawer closing device 90 on the horizontal flange 120 of the mounting bracket 100 is also provided on the bottom surface of the pull out rail 400.

FIGS. 14 and 15A to 15C show a stopper piece 440 also provided on the pull out rail bottom surface disposed toward its front end (relative to drawer orientation) with the stopper piece 440 preferably removably mounted on the bottom surface. The stopper piece 440 has a centrally located resilient attachment tab 450 on its top. An abutment protrusion 451 is provided on the top of the stopper piece 440 at its front end whereas a support protrusion 452 is provided at the rear portion. The stopper piece attachment tab 450 is engaged within the corresponding opening 460 provided on the pull out rail top surface while the abutment protrusion 451 catches against the front edge of the pull-out rail front end recess 490 and the support protrusion 452 abuts against the inner face of the pull-out rail bent-down portion. The stopper piece 440 is thus firmly affixed to the pull-out rail 400. The rear longitudinal end face (relative to drawer orientation in use) of the stopper piece 440 comprises an abutment surface 470 that is engagable with the mounting bracket stopper tab 210. Engagement of the stopper piece abutment surface 470 with the stopper tab 210 defines the rear travel limit of the pull out rail 400.

Figure 16:
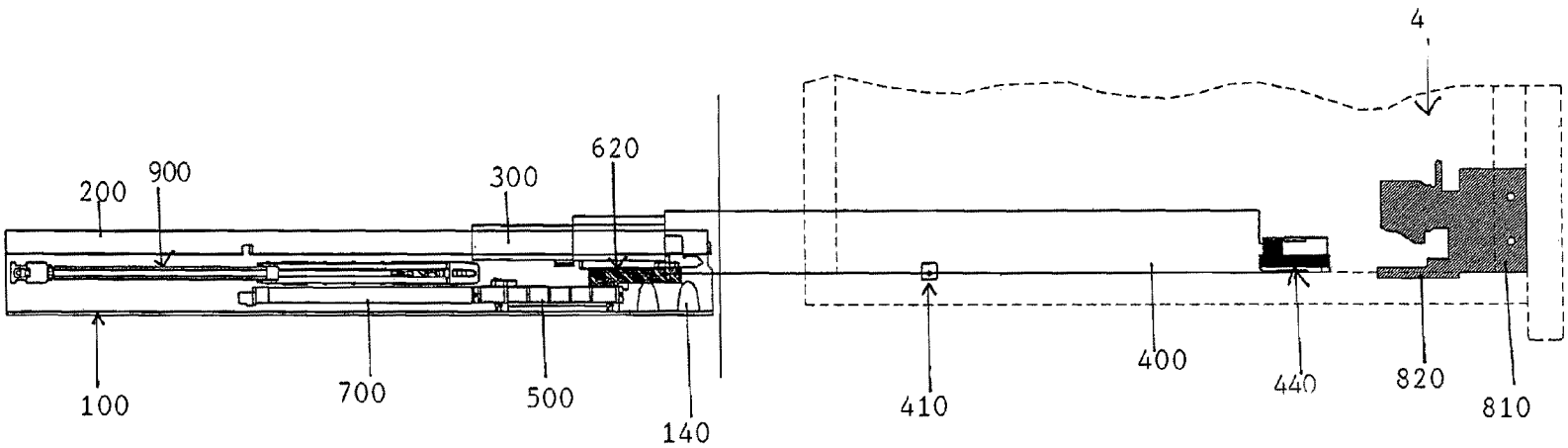
FIG. 16 shows a top view of the assembly of the embodiment of FIG. 11 with the drawer in a fully opened position.
Figure 17:
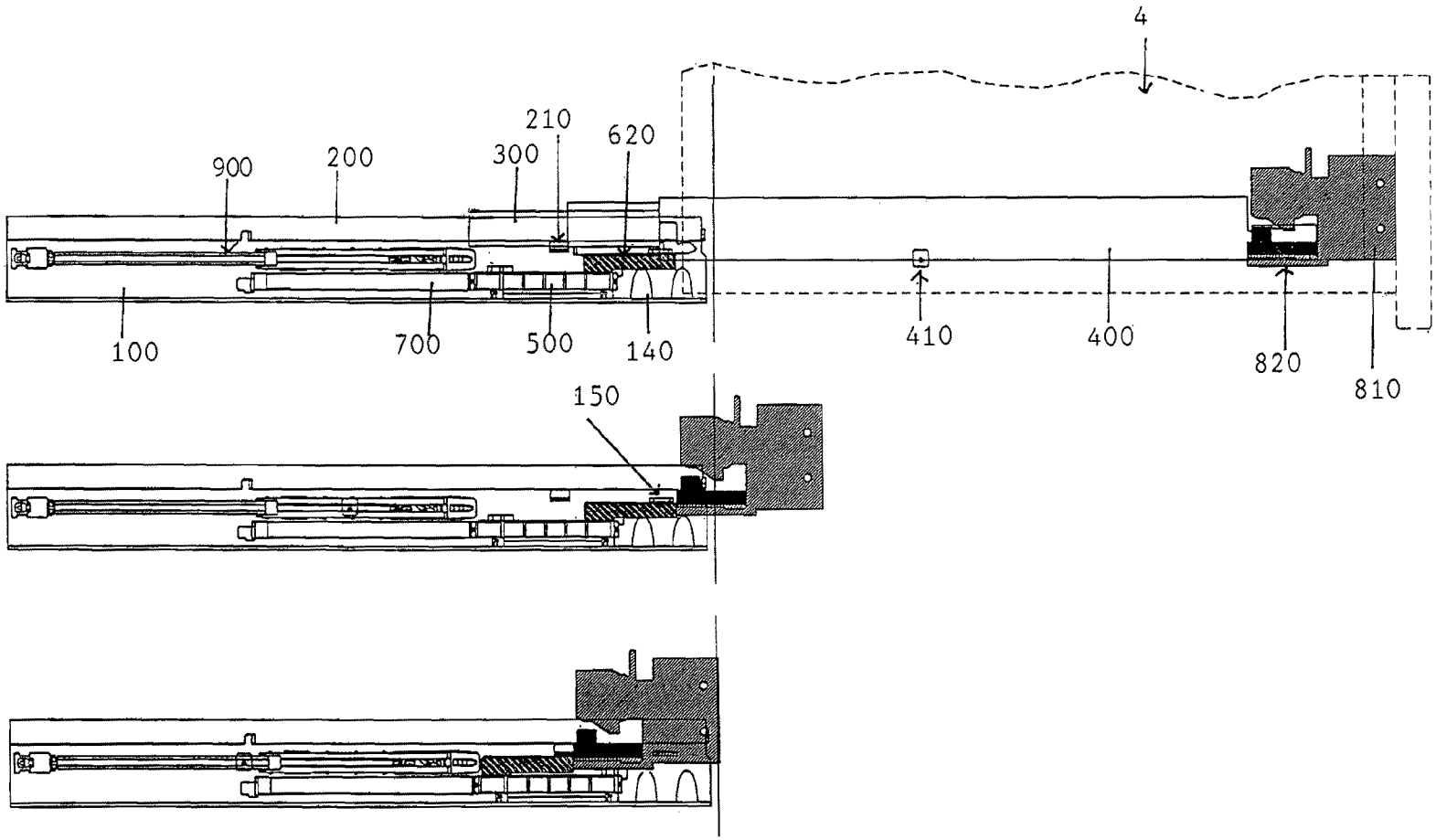
FIG. 17 is a top view of the assembly of the embodiment of FIG. 11 as the drawer is initially in a fully opened position and subsequently pushed into a fully closed position.

FIGS. 11, 16 and 17 show, in use, when the drawer is in a fully extended position, the outer pull out rail 400 of the guide rail assembly is in a fully extended position and the sliding member 600 within the channel guide 500 is at its front travel limit, abutting against the front longitudinal end of the channel guide slot 520. In this state, the rod of the damping device 700 with its distal end located within the sliding member 600 runs along the length of the channel guide 500. The outer pull out rail 400 (drawer bottom panel 4) is caused to slide in a drawer-closing direction as the drawer is pushed in. Subsequently, the drawer bottom contact piece 800 engages the terminal abutment surface 650 of the sliding member outer portion 620. At the same time, the guiding pin 410 of the pull out rail 400 engages the drawer closing device 90. In this state, the closing action of the guide rail system (and the drawer) is aided by the action of the drawer closing device 90. The engagement of the drawer bottom contact piece 800 with the terminal abutment surface 650 of the sliding member outer portion 620 urges the sliding member inner portion 610 to slidably travel within the channel guide 500. The sliding motion of the inner portion 610 in turn, causes the damping device 700 to be compressed in a lengthwise direction as the damping device rod is pushed into the cylinder body 710. Thus, the sliding motion of the sliding member 600 against the resilience of the damping device 700 will result in the deceleration of the drawer-closing motion.

The outer pull out rail 400 continues to slide inwardly until the drawer is fully closed. The pull out rail 400 sliding motion is halted at its rear travel limit as the abutment surface 470 of its stopper piece 440 engages the stopper tab 210 of the mounting bracket 100. In this position, the pull out rail 400 is said to be at its rear travel limit. Due to the location of the mounting bracket stopper tab 210 such that it is forward relative to the rear travel limit position of the sliding member 600, the sliding member 600 continues to be slidable even though the pull out rail 400 is at its rear travel limit and as such, stationary. The rear travel limit of the sliding member 600 is defined by the rear longitudinal end of the channel guide slot 520.

When the drawer is in a fully closed or pushed-in position, the outer pull out rail 400 of the guide rail system is at its rear travel limit with the abutment surface 470 of its stopper piece 440 engaged with the mounting bracket stopper tab 210 and its guiding pin 410 engaged with the drawer closing device 90. The damping device 700 is in a compressed state (majority length of the rod with its distal end located within the sliding member inner portion 610 pushed into cylinder body 710) and the terminal abutment surface 650 of the sliding member outer portion 620 is in contact with the drawer bottom contact piece 800. As the drawer is pulled out, the outer pull out rail 400 (drawer bottom panel) is caused to slide in a drawer-opening direction resulting in the pull out rail guiding pin 410 being disengaged from the drawer closing device 90 and the drawer bottom contact piece 800 being disengaged from the terminal abutment surface 650 of the sliding member outer portion 620. The damping device 700 will now be allowed to decompress in a lengthwise direction due to its resilient nature and the rod will be pushed out of its cylinder body 710. As the distal end of the rod is located within the sliding member inner portion 610, decompression of the damping device 700 will urge the forward sliding motion of the sliding member 600 within the channel guide 500 until it reaches its front travel limit (front longitudinal end of the channel guide slot 520).

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefor intended to be embraced therein.

The invention claimed is:

1. A drawer assembly comprising:

a drawer and a sliding guide rail system for slidably opening and closing the drawer within an article of furniture;

the drawer comprising a drawer side member (2) comprising a cover piece (2A) and a support bracket (2B), said cover piece fitting over said support bracket;

the sliding guide rail system comprising a mounting bracket (10) for fixing the drawer to the article of furniture, said mounting bracket having a fixed rail (20) for receiving an intermediate rail (30), an intermediate rail capable of sliding back and forth relative to said fixed rail, an outer pull out rail (40) operatively attached to said support bracket (2B) and being capable of sliding back and forth on said intermediate rail relative to said intermediate rail and said fixed rail, said support bracket (2B) configured to be static relative to the outer pull out rail;

a contact piece (80) provided on said support bracket (2B) of said drawer side member (2);

a damping device (70) and a channel guide (50) disposed along the mounting bracket (10) adjacent said fixed rail (20), said damping device being resiliently compressible in a lengthwise direction and said channel guide having a sliding member (60);

the sliding member (60) comprising an inner portion (61) that travels within the guide and an outer portion (62) that extends from the guide so as to be contactable by said drawer side contact piece (80), said inner portion locating an end of the damping device (70) that can be pushed inwardly to provide damping, wherein, during a closing action of the assembly, both the drawer and the outer pull out rail (40) is caused to slide in a drawer-closing direction and when said drawer side contact piece (80) reaches and engages the sliding member outer portion (62), the sliding member (60) travels within said channel guide (50) against the resilience of said damping device (70) and causes deceleration of the drawer-closing motion.

2. A drawer assembly as claimed in claim 1, wherein said drawer side contact piece (80) is removably affixed to the bottom of the drawer side support bracket (2B) so as to be engageable with said sliding member outer portion (62).

3. A drawer assembly as claimed in claim 2, wherein said drawer side contact piece (80) comprises an attachment part (81) and a contact part (82), said attachment part for removably attaching the contact piece to the support bracket (2B) and said contact part for engagement with said sliding member outer portion (62).

4. A drawer assembly as claimed in claim 3, wherein said drawer side contact piece contact part (82) further comprises a substantially T-shaped abutment face (86) engageable with said sliding member outer portion (62).

5. A drawer assembly as claimed in claim 1, wherein said damping device (70) comprises a cylinder body (71) and a rod that is pushable into the cylinder body when the device is compressed, an end of the rod being located in the sliding member inner portion (61).

6. A drawer assembly as claimed in claim 1, wherein said damping device (70) is a fluid damper.

7. A drawer assembly as claimed in claim 1, wherein said channel guide (50) is a U-shaped channel having an open side and open longitudinal ends such that the sliding member outer portion (62) extends outwardly through the open side of the channel guide and the sliding member inner portion (61) receives said end of the damping device (70) through an open longitudinal end.

8. A drawer assembly as claimed in claim 7, wherein said sliding member inner portion (61) further comprises an aperture for receiving said end of the damping device (70).

9. A drawer assembly as claimed in claim 1, wherein said fixed rail (20) further comprises a stopper tab (21) located at a position on the fixed rail upper surface such that the stopper tab is forward relative to a rear travel limit position of the sliding member (60) within the channel guide (50).

10. A drawer assembly as claimed in claim 9, wherein said stopper tab (21) is an L-shaped tab.

11. A drawer assembly as claimed in claim 10, wherein said outer pull out rail (40) further comprises a stopper piece (44) engageable with said fixed rail stopper tab (21).

12. A drawer assembly as claimed in claim 11, wherein said outer pull out rail stopper piece (44) is disposed toward a front end of the pull out rail (40).

13. A drawer assembly as claimed in claim 11, wherein said outer pull out rail stopper piece (44) is removable from the pull out rail (40).

14. A drawer assembly as claimed in claim 1, wherein the fixed rail (20) and outer pull out rail (40) each further comprises a slidable housing having a plurality of rollers that enables the intermediate rail (30) to be slidable on the fixed rail and the outer pull out rail to be in turn slidable on the intermediate rail.

* * * * *